US009504366B2

(12) United States Patent
Kasper et al.

(10) Patent No.: US 9,504,366 B2
(45) Date of Patent: Nov. 29, 2016

(54) BARE FLOOR CLEANER

(71) Applicant: BISSELL Homecare, Inc., Grand Rapids, MI (US)

(72) Inventors: Gary A. Kasper, Grand Rapids, MI (US); Joseph M. White, Grand Rapids, MI (US); John L. Jansen, Hong Kong (CN); Aaron P. Griffith, Grand Rapids, MI (US); Yu Xiaoming, Suzhou (CN); Yang Caiyin, Suzhou (CN)

(73) Assignee: BISSELL Homecare, Inc., Grand Rapids, MI (US)

( * ) Notice: Subject to any disclaimer, the term of this patent is extended or adjusted under 35 U.S.C. 154(b) by 747 days.

(21) Appl. No.: 13/911,422

(22) Filed: Jun. 6, 2013

(65) Prior Publication Data

US 2013/0333154 A1 Dec. 19, 2013
US 2014/0196242 A2 Jul. 17, 2014

Related U.S. Application Data

(63) Continuation of application No. 12/778,615, filed on May 12, 2010, now Pat. No. 8,458,850.

(60) Provisional application No. 61/177,391, filed on May 12, 2009.

(51) Int. Cl.

| | |
|---|---|
| ***A47L 11/26*** | (2006.01) |
| ***A47L 11/40*** | (2006.01) |
| ***A47L 13/22*** | (2006.01) |

(52) U.S. Cl.

CPC ..... *A47L 11/26* (2013.01); *A47L 11/4027* (2013.01); *A47L 11/4041* (2013.01); *A47L 11/4086* (2013.01); *A47L 13/22* (2013.01); *A47L 13/225* (2013.01)

(58) Field of Classification Search

CPC .. A47L 11/34; A47L 13/225; A47L 11/4086; A47L 11/4044; A47L 11/28; A47L 11/4075; A47L 11/4041; A47L 11/4027; A47L 13/22; A47L 11/29

See application file for complete search history.

(56) References Cited

U.S. PATENT DOCUMENTS

| | | | | |
|---|---|---|---|---|
| 1,644,189 | A | 10/1927 | Hendricks | |
| 3,344,453 | A | 10/1965 | Price | |
| 4,433,451 | A | 2/1984 | Parisi | |
| 6,845,538 | B2 | 1/2005 | Nakamura | |
| 6,966,098 | B2 | 11/2005 | Sako et al. | |
| 7,013,528 | B2 | 3/2006 | Parker et al. | |
| 7,640,626 | B2 | 1/2010 | Oh | |
| 7,811,022 | B2 * | 10/2010 | Bobrosky | A47L 9/04 15/209.1 |

(Continued)

FOREIGN PATENT DOCUMENTS

| | | |
|---|---|---|
| CN | 2759371 | 2/2006 |
| CN | 2917533 | 5/2006 |

(Continued)

OTHER PUBLICATIONS

Markus Masset, European Search Report, Aug. 8, 2012, 1 page.

*Primary Examiner* — Robert Scruggs
(74) *Attorney, Agent, or Firm* — McGarry Bair PC

(57) ABSTRACT

A bare floor cleaner with an upright assembly pivotally mounted to a base assembly, a steam generator, a fluid distributor which distributes steam onto the surface to be cleaned, and a mop cloth provided on the base assembly. The mop cloth is mounted to the base assembly by a mop cloth plate that is removable from the base assembly.

20 Claims, 17 Drawing Sheets

(56) References Cited

U.S. PATENT DOCUMENTS

| | | | | |
|---|---|---|---|---|
| 2004/0134016 | A1 | 7/2004 | Kisela et al. | |
| 2005/0181968 | A1 | 8/2005 | Policicchio et al. | |
| 2006/0090284 | A1 | 5/2006 | Chen | |
| 2006/0150363 | A1 | 7/2006 | Choi | |
| 2009/0044351 | A1 | 2/2009 | Menrik et al. | |
| 2009/0064448 | A1* | 3/2009 | Oh | A47L 9/325 15/320 |

FOREIGN PATENT DOCUMENTS

| | | | |
|---|---|---|---|
| DE | 202007017026 | U1 | 4/2009 |
| EP | 1027855 | A2 | 1/2000 |
| EP | 1652460 | A1 | 10/2004 |
| EP | 1654973 | A1 | 5/2006 |
| EP | 1679027 | A1 | 7/2006 |
| WO | 2005011461 | A1 | 2/2005 |
| WO | 2009077169 | A2 | 6/2009 |

* cited by examiner

BARE FLOOR CLEANER

CROSS-REFERENCE TO RELATED APPLICATION

This application is a continuation of U.S. application Ser. No. 12/778,615, filed May 12, 2010, now U.S. Pat. No. 8,458,850, issued Jun. 11, 2013, which claims the benefit of U.S. Provisional Patent Application No. 61/177,391, filed May 12, 2009, both of which are incorporated herein by reference in their entirety.

BACKGROUND OF THE INVENTION

Field of the Invention

This invention relates to an upright bare floor cleaner. In one aspect, the invention relates to an upright steam cleaner having a mop cloth to absorb moisture and to capture small dust and dirt particles. In yet another aspect, the invention relates to an upright steam cleaner incorporating an easily mounted and removable mop cloth.

Description of the Related Art

The common procedure of cleaning a bare floor surface, such as tile, linoleum, and hardwood floors, involves several steps. First, dry or loose dust, dirt, and debris are removed, and then liquid cleaning solution is applied to the surface either directly or by means of an agitator. Motion of the agitator with respect to the bare surface loosens the remaining dirt. The agitator can be a stationary brush or cloth that is moved by the user, or a motor-driven brush that is moved with respect to a base support. If the agitator is absorbent, it will remove the dirt and collect a portion of the soiled cleaning solution from the floor.

Cleaning a bare floor commonly requires multiple cleaning tools. For example, a conventional broom and dustpan are often utilized during the first step to remove dry debris. A user sweeps dry debris into a pile and then transfers the pile to the dustpan for disposal. However, the broom and dustpan are not ideal for removing dry particles because it is difficult to transfer the entire debris pile into the dustpan. Additionally, the user typically bends over to hold the dustpan in place while collecting the debris pile. Such motion can be inconvenient, difficult, and even painful for some users. Dust cloths can also be used, but large dirt particles do not sufficiently adhere thereto. Another option is vacuuming the dry debris, but most homes are equipped with vacuum cleaners that are designed for use on carpets and can damage bare surfaces and offer marginal cleaning performance on bare floor surfaces.

Tools for applying and/or agitating cleaning solution have similar deficiencies. The most common cleaning implement for these steps is a traditional sponge or rag mop. Mops are capable of loosening dirt from the floor and have excellent absorbency; however, when the mop requires more cleaning solution, it is placed in a bucket to soak up warm cleaning solution and returned to the floor. Each time more cleaning solution is required, the mop is usually placed in the same bucket, and after several repetitions the cleaning solution becomes dirty and cold. As a result, dirty cleaning solution is used to remove dirt from the bare surface. Mops generally require use of chemicals which can be problematic for users that have allergies or other sensitivities to cleaning chemicals, fragrances, etc. The end result tends to be a wet floor that is coated with soap residue upon drying. Furthermore, movement of the mop requires physical exertion, and the mop head wears with use and must be replaced periodically. Textured cloths can be used as an agitator, but they also require physical exertion and regular replacement. Additionally, cloths are not as absorbent as mops and, therefore, can leave excessive soiled cleaning solution on the floor.

Some household cleaning devices have been developed to simplify the cleaning process by reducing the number of cleaning steps required and eliminating the need for multiple cleaning implements These devices alleviate some of the problems described above that are associated with the individual tools. Such cleaning devices are usually adapted for vacuuming or sweeping dry dirt and dust prior to application of cleaning solution, applying and agitating the cleaning solution, and, subsequently, vacuuming the soiled cleaning solution into a recovery tank, thereby leaving only a small amount of cleaning solution on the bare surface. Common agitators are rotating brushes, rotating mop cloths, and stationary or vibrating sponge mops. A good portion of the multifunctional cleaning devices utilize an accessory that is attached to the cleaning device to convert between dry and wet cleaning modes. Other devices are capable of performing all functions without accessories, but have complex designs and features that can be difficult and confusing to operate. Further, upon completion of a cleaning task a mixture of soiled cleaning solution and dirt remains in the recovery tank forming sludge that is undesirable to dispose in the trash or down a sink drain.

Another development in the cleaning of bare floors is the use of steam as the cleaning agent. The cleaning machine incorporates a boiler or other means for generating steam. The steam is pumped to an applicator where it is brought into contact with the surface being cleaned. Because the steam is airborne, it may be undesirable to include detergents and the like in the cleaning solution. The steam cleaning systems generate steam at a temperature that effectively kills a wide range of microbes, bacteria, microorganisms, and dust mites. However, the steam cleaning systems can suffer from poor cleaning performance. Additionally, the high power required for generating steam does not allow ample remaining power for running a vacuum motor, so cleaning performance is further hindered. Conversely, conventional detergent cleaning systems are somewhat effective at cleaning surfaces, but could be made more effective by raising the temperature of the cleaning solution to some point below the boiling point. Overall power consumption presents a major hurdle in North America and other 120V markets when contemplating the combination of steaming and vacuum cleaning functions. Accordingly, it becomes extremely difficult to combine effective vacuum cleaning function with a simultaneous steaming function without running the risk of tripping residential circuit breakers.

A bare floor cleaner has heretofore been sold in the United States by BISSELL Homecare, Inc. under the mark Steam Mop™. The Steam Mop comprises a base assembly and an upright handle pivotally mounted to the base assembly. The base assembly includes a base housing with a fluid distributor for distributing fluid to the surface to be cleaned; and a mop cloth which is affixed beneath the base housing and positioned for contacting the surface to be cleaned. The upright handle includes a handle housing; a water tank mounted to the handle housing and adapted to hold a quantity of water; a fluid distribution system between the water tank and the base housing fluid distributor for distributing fluid from the water tank to the mop cloth for applying the steam to the surface to be cleaned; and a heating element within the fluid distribution system for heating the water from the water tank to steam. The Steam Mop steam cleans, sanitizes, and does not leave chemical residue on the surface after use. Further, the Steam Mop is compact, easily maneuverable, and runs quietly during operation. However, it still requires two cleaning steps—namely, sweeping or vacuuming dry debris followed by steam mopping.

SUMMARY OF THE INVENTION

According to the invention, a bare floor cleaner comprises a base housing which is movable along a surface to be cleaned, an upright housing pivotally mounted to the base housing, a steam generator mounted in one of the base housing and the upright housing, a mop cloth plate removably mounted to the base housing, a mop cloth removably mounted to the mop cloth plate and positioned for contacting the surface to be cleaned, and a fluid distributor mounted in the base housing and connected to the steam generator to distribute steam to the mop cloth, wherein the mop cloth is configured to be removably retained on the mop cloth plate so that the mop cloth plate and the mop cloth can be simultaneously removed from or mounted to the base housing as a unit.

DESCRIPTION OF EMBODIMENTS OF THE INVENTION

Figure 1:
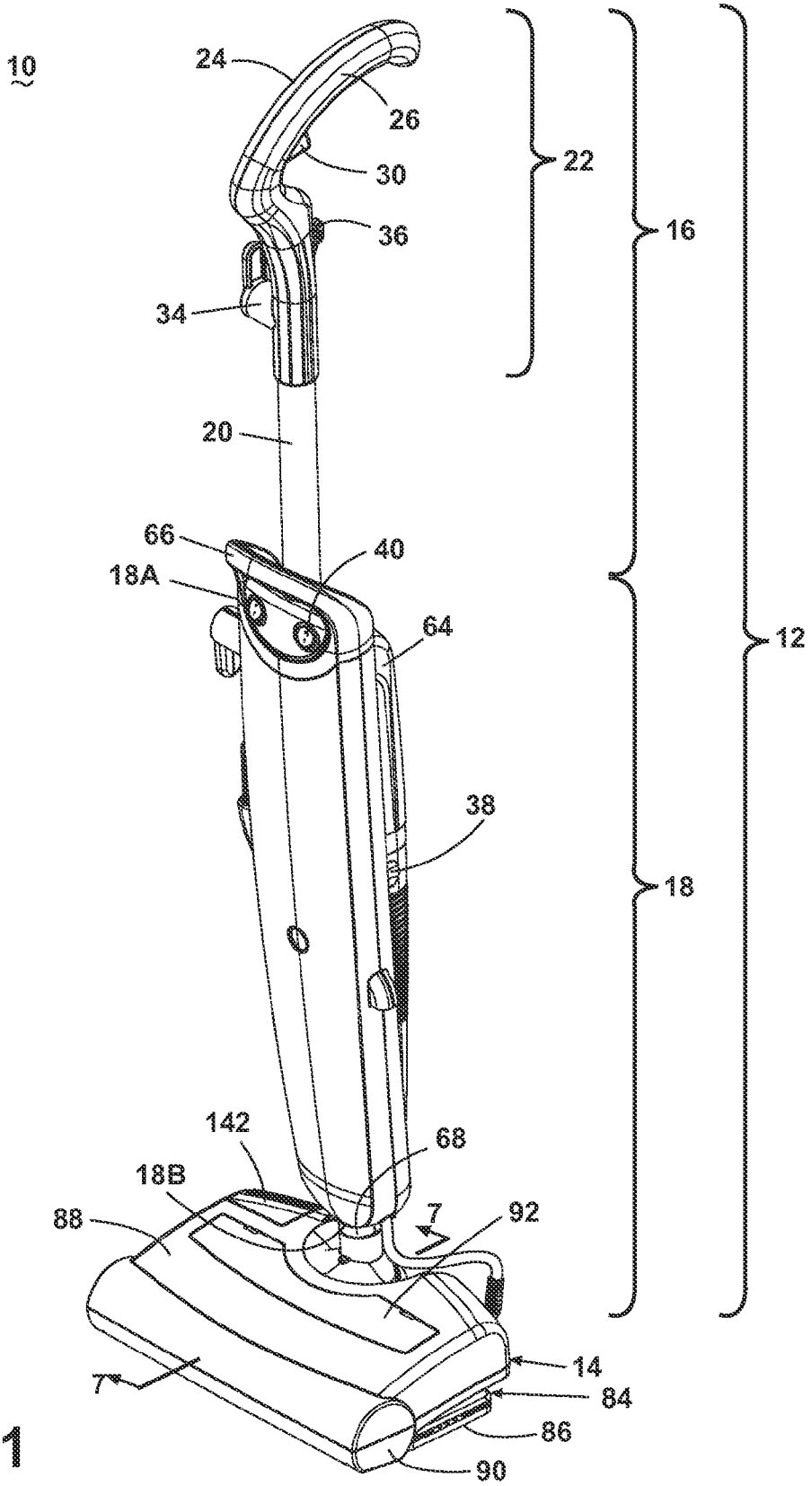
FIG. 1 shows a steam mop sweeper according to a first embodiment of the invention.
Figure 2:
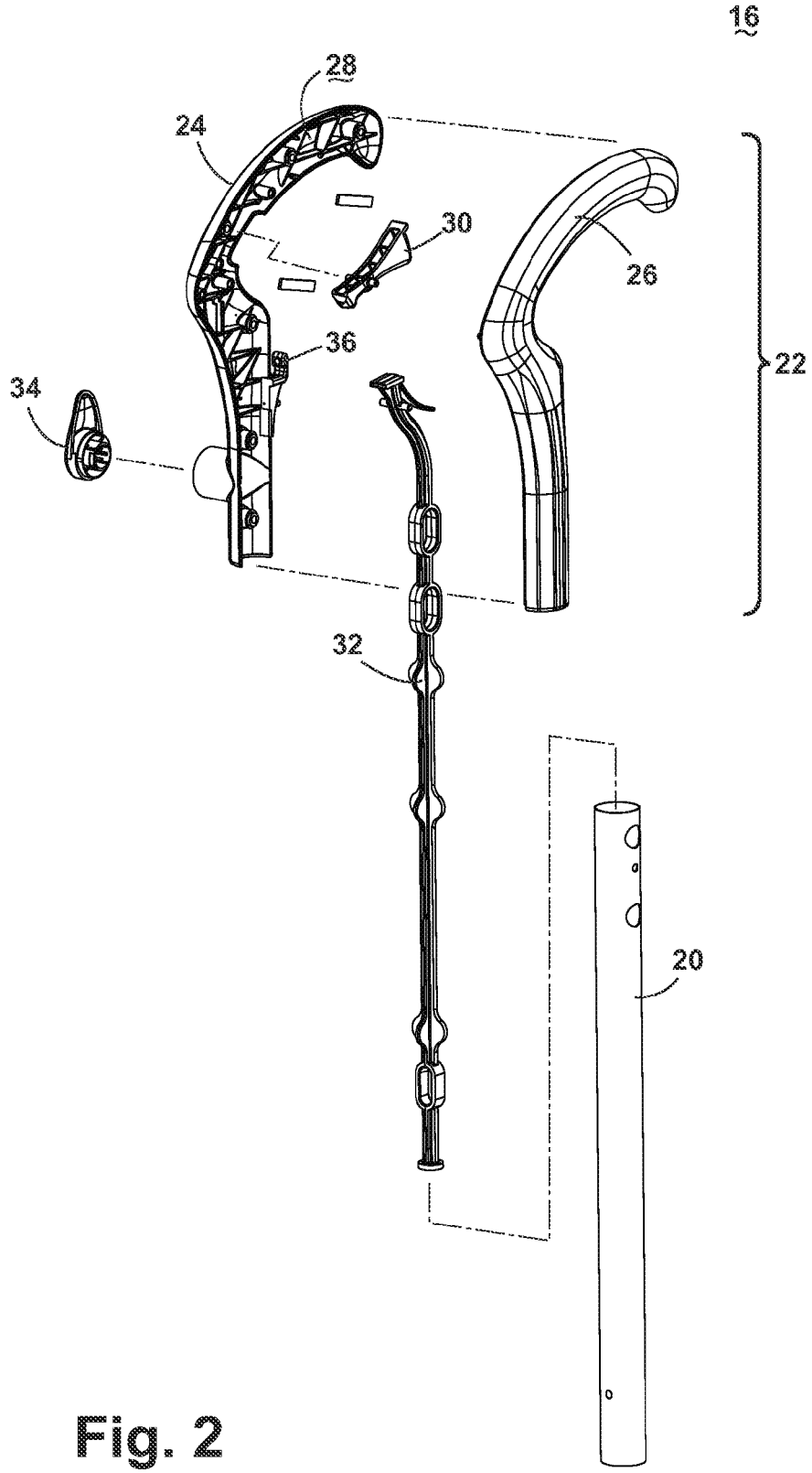
FIG. 2 is an exploded view of an upper handle assembly of the steam mop sweeper shown in FIG. 1.

Referring now to the drawings and to FIGS. 1 and 2 in particular, a steam mop sweeper 10 according to the invention comprises an upright handle assembly 12 pivotally mounted to a foot or base assembly 14. The handle assembly 12 can pivot from an upright or vertical position, where the handle assembly 12 is substantially vertical relative to a surface to be cleaned, to a lowered position, whereby the handle assembly 12 is respectively moved in a rearward direction relative to the base assembly 14 and is angled relative to the surface to be cleaned. The steam mop sweeper 10 does not incorporate traditional wheels associated with vacuums; instead, the steam mop sweeper 10 is adapted to glide across the surface on a mop cloth 86.

The handle assembly 12 comprises an upper handle assembly 16 and a lower handle assembly 18. The upper handle assembly 16 comprises a hollow handle tube 20 having a grip assembly 22 fixedly attached to a first end of the handle tube 20 and the lower handle assembly 18 fixedly attached to a second end of the handle tube 20 via screws or other suitable commonly known fasteners. The grip assembly 22 has an arcuate grip portion; however, it is within the scope of the invention to utilize other grips commonly found on other machines, such as closed-loop grips having circular or triangular shapes. Referring to FIG. 2, the grip assembly 22 comprises a right handle half 24 that mates with a left handle half 26 and provides a user interface to manipulate the steam mop sweeper 10. Additionally, the mating handle halves 24, 26 form a cavity 28 therebetween. A trigger 30 is partially mounted within the cavity 28, with a portion of the trigger 30 projecting outwardly from the grip assembly 22 where it is accessible to the user. The remainder of the trigger 30 resides in the cavity 28 formed by the handle halves 24, 26 and communicates with a push rod 32 that is positioned within the hollow interior of the handle tube 20. The trigger 30 is pivotally mounted to the handle halves 24, 26 so that the trigger 30 can rotate relative to the grip assembly 22 in a conventional manner. The grip assembly 22 further comprises a cord wrap 34, and a cord lock 36. The cord wrap 34 is adapted to support an electrical cord (not shown) when not in use, and the cord lock 36 is adapted to retain one loop of the electrical cord near the top of the handle assembly 12 during use, thus keeping the cord out of the sweeper's path.

Figure 3:
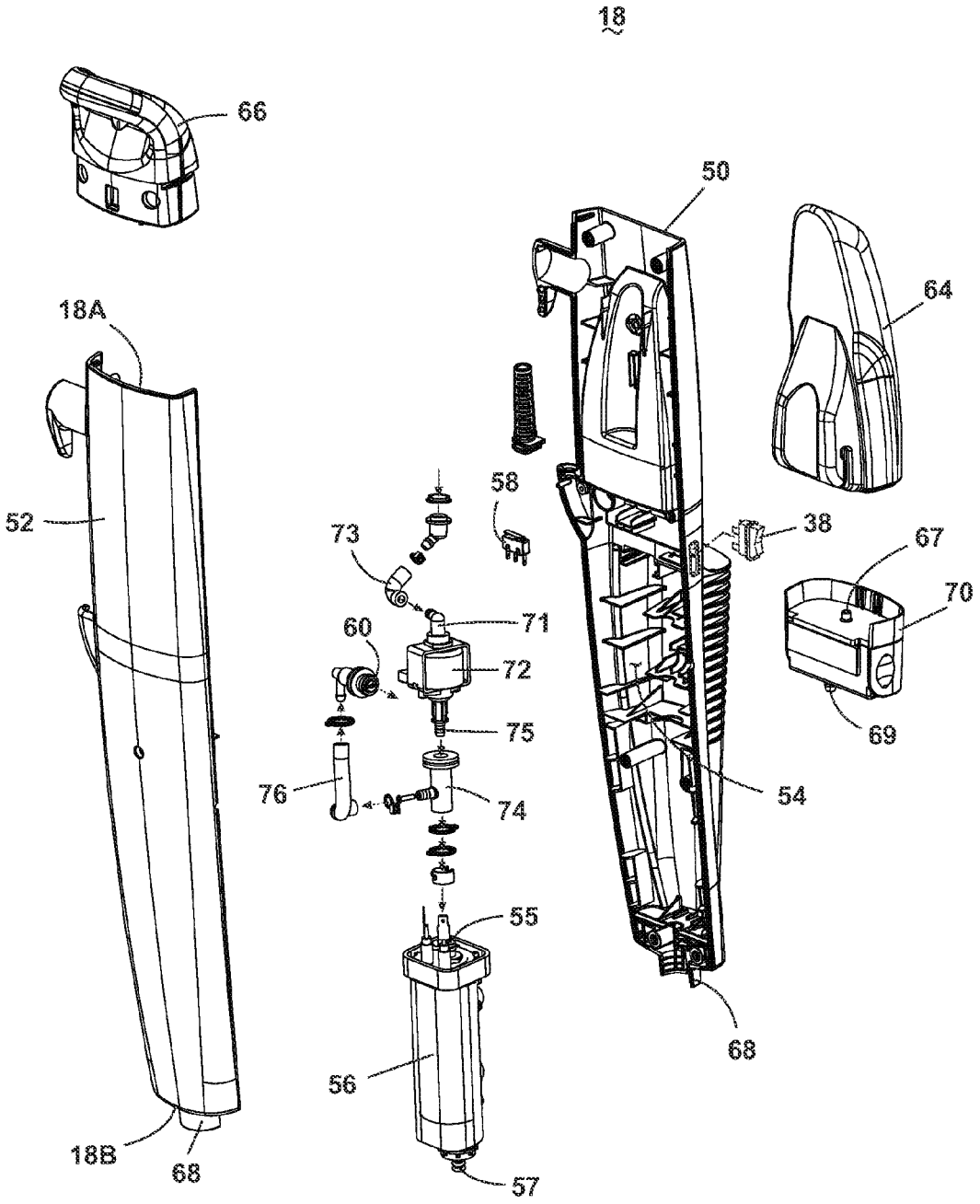
FIG. 3 is an exploded view of a lower handle assembly of the steam mop sweeper shown in FIG. 1.

As shown in FIG. 3, the lower handle 18 mounts a power switch 38 and comprises a generally elongated rear enclosure 50 that provides structural support for components of the steam mop sweeper 10 contained therein. The rear and front enclosures 50, 52 define an upright housing. A front enclosure 52 mates with the rear enclosure 50 to form a central cavity 54 therebetween. A heating element 56, a micro-switch 58, and a pressure relief valve 60 are mounted in the central cavity 54. The lower handle 18 comprises an upper end 18A and a lower end 18B, and a carry handle 66 located at the upper end 18A. The carry handle 66 is disposed at an angle relative to the tube 20 and facilitates manually lifting the steam mop sweeper 10 from the surface to be cleaned. The lower end 18B of the lower handle 18 comprises a generally circular conduit 68 by which the handle assembly 12 is mounted to the base assembly 14. The power switch 38 is a conventional on/off rocker switch design and is mounted by any suitable means to the lower handle 18. As illustrated, the power switch 38 is shown mounted to the rear enclosure 50, however other locations are feasible, such as the front enclosure 52.

Figure 4:
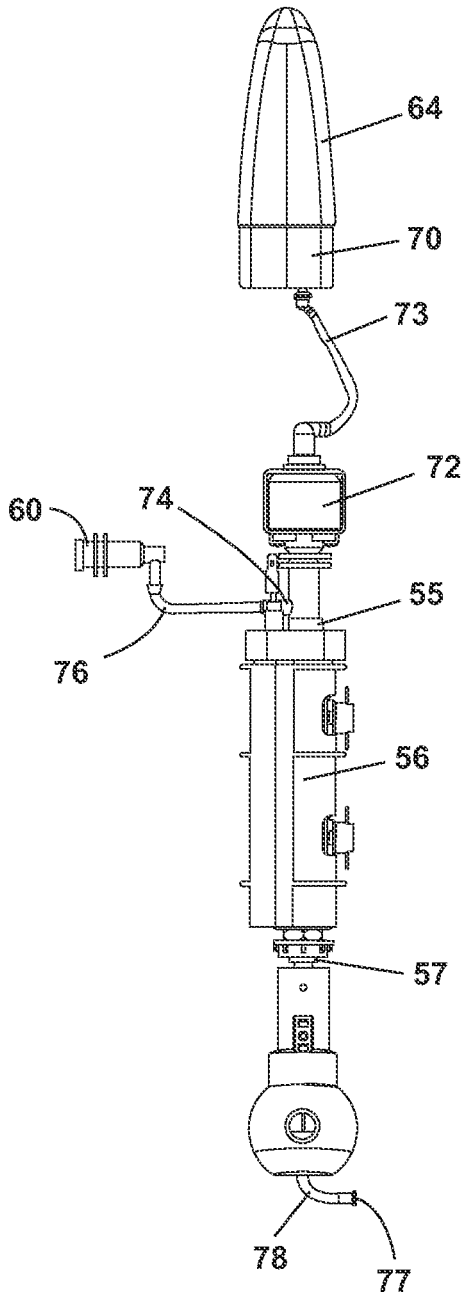
FIG. 4 is a diagram of a fluid distribution system of the steam mop sweeper shown in FIG. 1.

Referring additionally to FIG. 4 in which the fluid distribution system is diagrammatically shown, the fluid distribution system conveys fluid from a water tank assembly 64 to a spray nozzle 77 that is mounted in an aperture 79 (FIG. 6) in the lower surface of the base assembly 14 and through which steam is applied to the mop cloth 86, as described hereinafter. The water tank assembly 64 is removably mounted to the lower handle 18 in a recess 62 in the rear enclosure 50. Alternatively, the fluid distribution system including the water tank assembly 64 can be mounted to the base assembly 14. The water tank assembly 64 comprises a tank with an inlet/outlet to hold a predetermined amount of liquid, particularly water. The water tank assembly 64 is in fluid communication with a filter assembly 70, which is comprised of a housing having an inlet 67 and an outlet 69 and which contains de-ionizing crystals. A first water tube 73 fluidly communicates between an inlet port 71 for a pump 72 and the filter assembly 70. An outlet port 75 of the pump 72 fluidly communicates with a T-connector 74. The T-connector 74 is fluidly connected to both a pressure relief valve 60, via a second water tube 76, and the heating element 56.

The heating element 56 is electrically coupled to the power source and has an elongated boiler that includes an inlet 55 at one end fluidly connected to the pump 72 via the T-connector 74. Filtered water is heated while passing through the heating element 56 and exits at its opposite end, via an outlet port 57, which is fluidly connected to a steam tube 78. The steam tube 78 is routed through the pivot joint, to be described below, that connects the lower handle assembly 18 to the base assembly 14. The spray nozzle 77 is connected at the distal end of the steam tube 78 for dispensing steam to the mop cloth 86 (FIG. 1).

The fluid distribution system is controlled by the microswitch 58, which is electrically connected to the pump 72. The pump 72 is selectively activated when the user depresses the trigger 30, which forces the push rod 32 to travel a predetermined distance along its longitudinal axis to actuate the microswitch 58. Depressing the trigger 30 actuates the microswitch 58 and energizes the pump 72 to dispense steam onto the surface to be cleaned.

Figure 6:
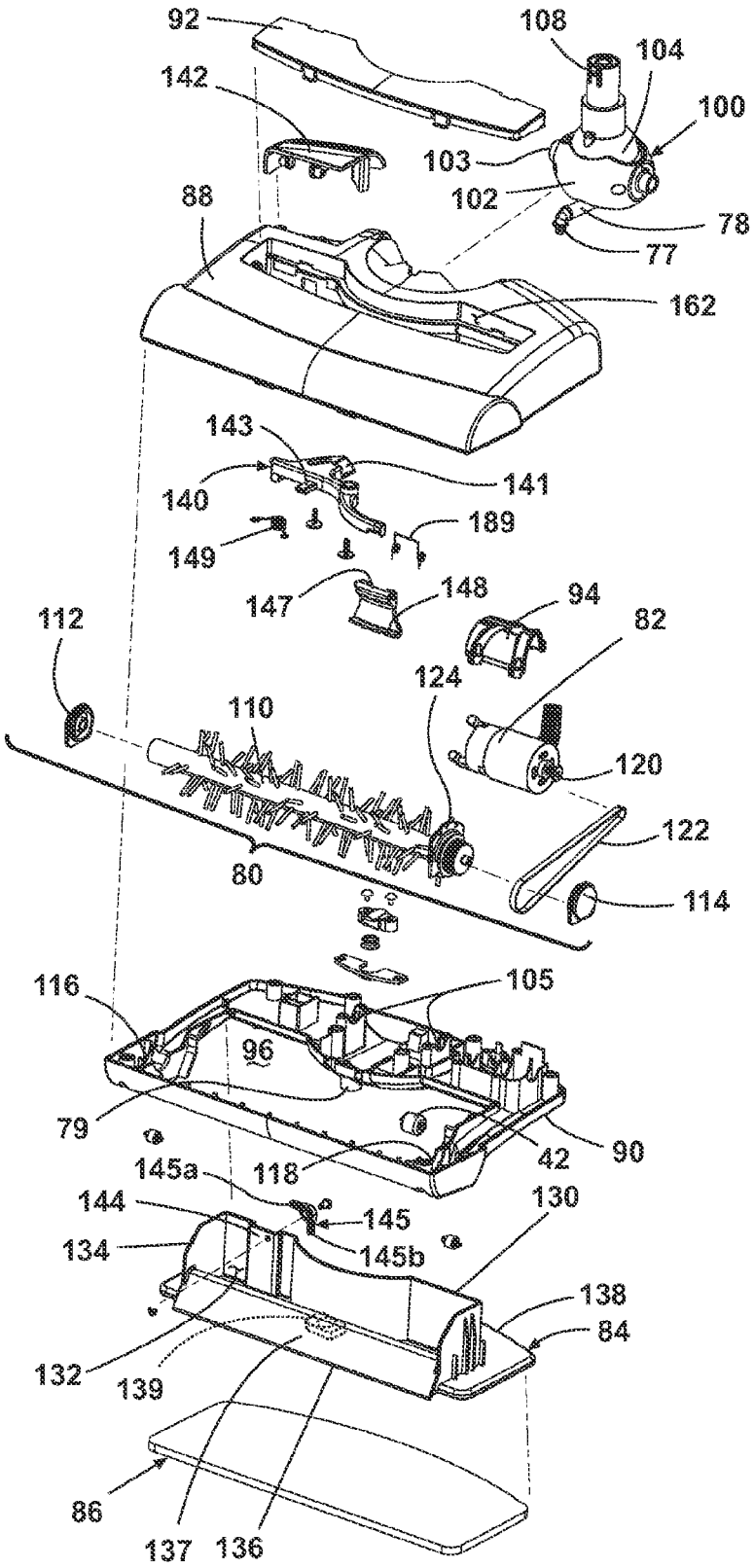
FIG. 6 is an exploded view of a base assembly of the steam mop sweeper shown in FIG. 1.
Figure 6A:
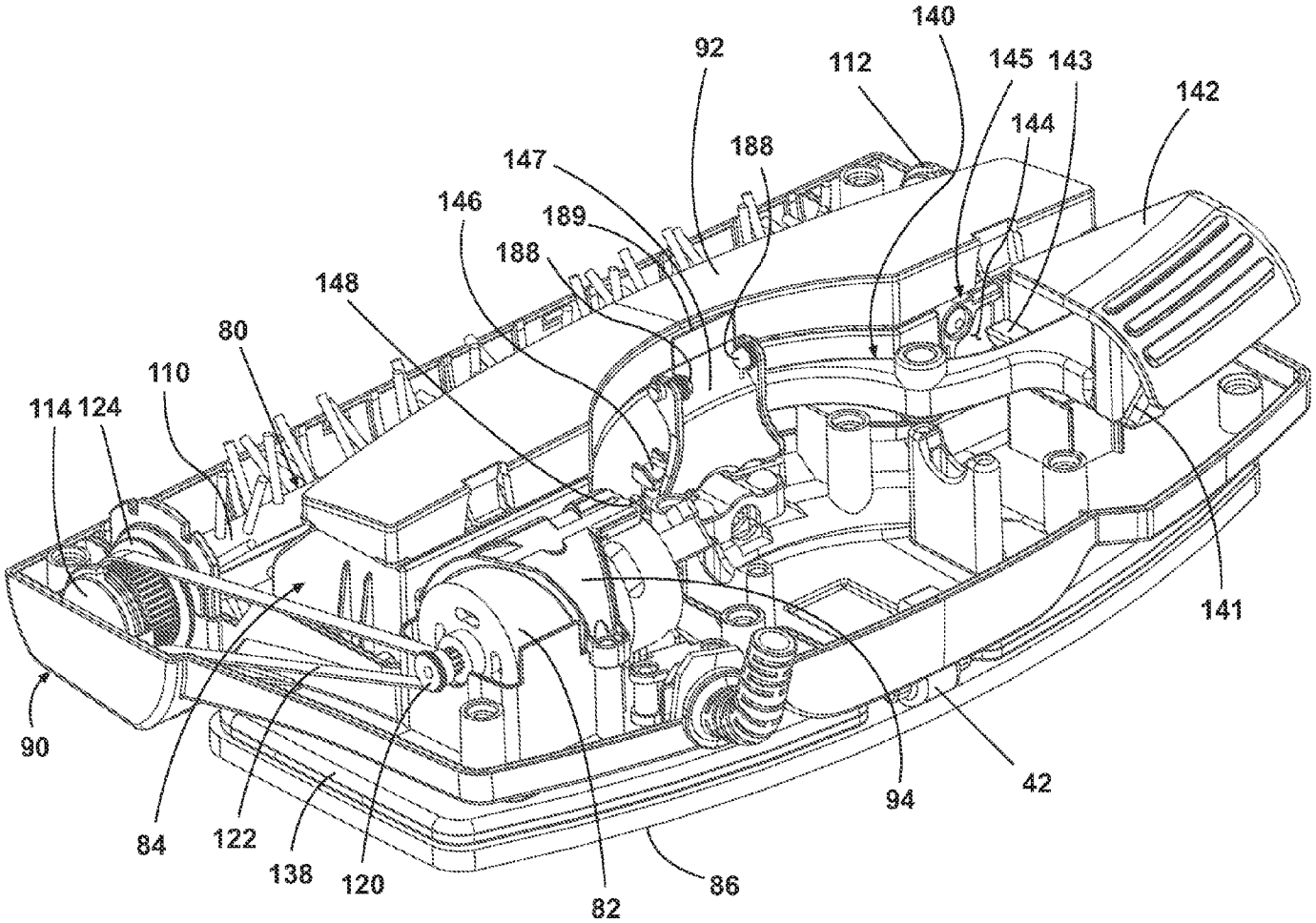
FIG. 6A is perspective view of the base assembly of the steam mop sweeper of FIG. 1, with an upper housing removed to show the interior components.

As shown in FIG. 6, the base assembly 14 encloses various components of a sweeper, including a rotatably mounted brush assembly 80, a motor 82, and a dirt receptacle 84. According to one embodiment of the invention, the steam mop sweeper 10 additionally comprises the mop cloth 86, as hereinafter described. The brush assembly 80, motor 82, dirt receptacle 84, and spray nozzle 77 are enclosed within a base housing generally comprising an upper housing 88, a base plate 90, and a dirt receptacle cover 92.

The base plate 90 comprises a panel-like body incorporating various sized cradles and attachment points for fixedly supporting the rotatably mounted brush assembly 80, a motor mount 94, the dirt receptacle 84, and the spray nozzle 77. The base plate 90 is provided at the forward end with a generally rectangular-shaped opening 96 therein. The base plate 90 also provides structural support for a handle pivot assembly 100 for pivotally mounting the handle assembly 12 to the base assembly 14. Further, the base plate 90 includes the through-hole aperture 79 positioned to enable steam to be distributed from the spray nozzle 77 to a mop cloth 86 in contact with the surface to be cleaned.

Figure 5:
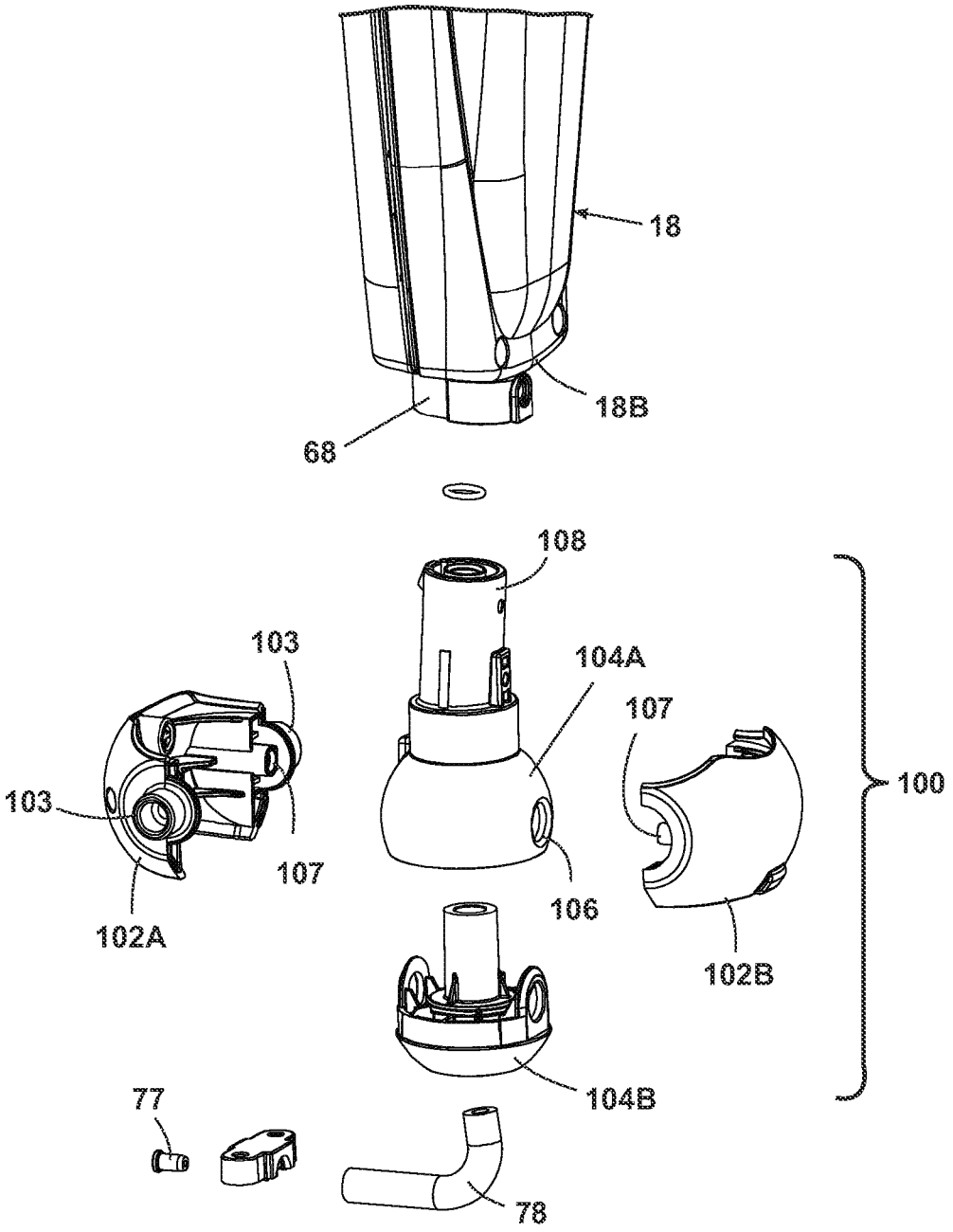
FIG. 5 is exploded view of a handle pivot assembly connecting the handle assembly to the base assembly of the steam mop sweeper shown in FIG. 1.

Referring to FIGS. 5 and 6, the handle assembly 12 is pivotally mounted to the base assembly 14 at lower end 18 through the handle pivot assembly 100. The handle pivot assembly 100 comprises an exterior pivot ball 102 and an interior pivot ball 104 that is located inside the exterior pivot ball 102. Each pivot ball 102, 104 is split into two mating portions 102A, 102B, 104A, 104B to ease manufacturing and assembly. The interior pivot ball 104 has a tubular shaft 108 that projects upward from the curved surface and fixedly attaches to conduit 68 at the lower end 18B of the lower handle assembly 18 for mounting the handle assembly 12 to the base assembly 14. The exterior pivot ball 102 includes two exterior pivot arms 103 that are received in two cradles 105 on the base plate 90. The exterior pivot ball 102 is retained on the pivot cradles 105 by the upper housing 88 when it is mated to the base plate 90. The interior surface of the exterior pivot ball 102 incorporates two additional pivot arms 107 for mounting the interior pivot ball 104. The interior pivot ball 104 comprises a pair of linearly spaced holes 106 through which the pivot arms 107 pass and are retained. The axis of the two pairs of pivot arms 103 and 107 are positioned at 90° to each other. The pivot arms 103 define an axis about which the exterior pivot ball 102 can rotate, enabling the handle assembly 12 to rotate forwardly and rearwardly with respect to the base assembly 14. The pivot arms 107 define an axis about which the interior pivot ball 104 can rotate, enabling the handle assembly 12 to rotate side-to-side with respect to the base assembly 14. The described pivot assembly 100 thus enables the base assembly 14 to swivel multi-axially relative to the handle assembly 12. Additionally, the handle assembly 12 can incorporate an upright locking device (not shown) to lock the steam mop sweeper in an upright position.

The motor mount 94 is fixed by any suitable means to the base plate 90 for housing the motor 82. The motor 82 comprises a generally conventional, electric motor that draws only 10 watts, has sufficient power for the purposes described herein, and is electrically connected to a power cord (not shown). The motor 82 is selectively energized by a brush power switch 40 shown in FIG. 1. The motor 82 is mechanically connected to the brush assembly 80 as described below.

Figure 7:
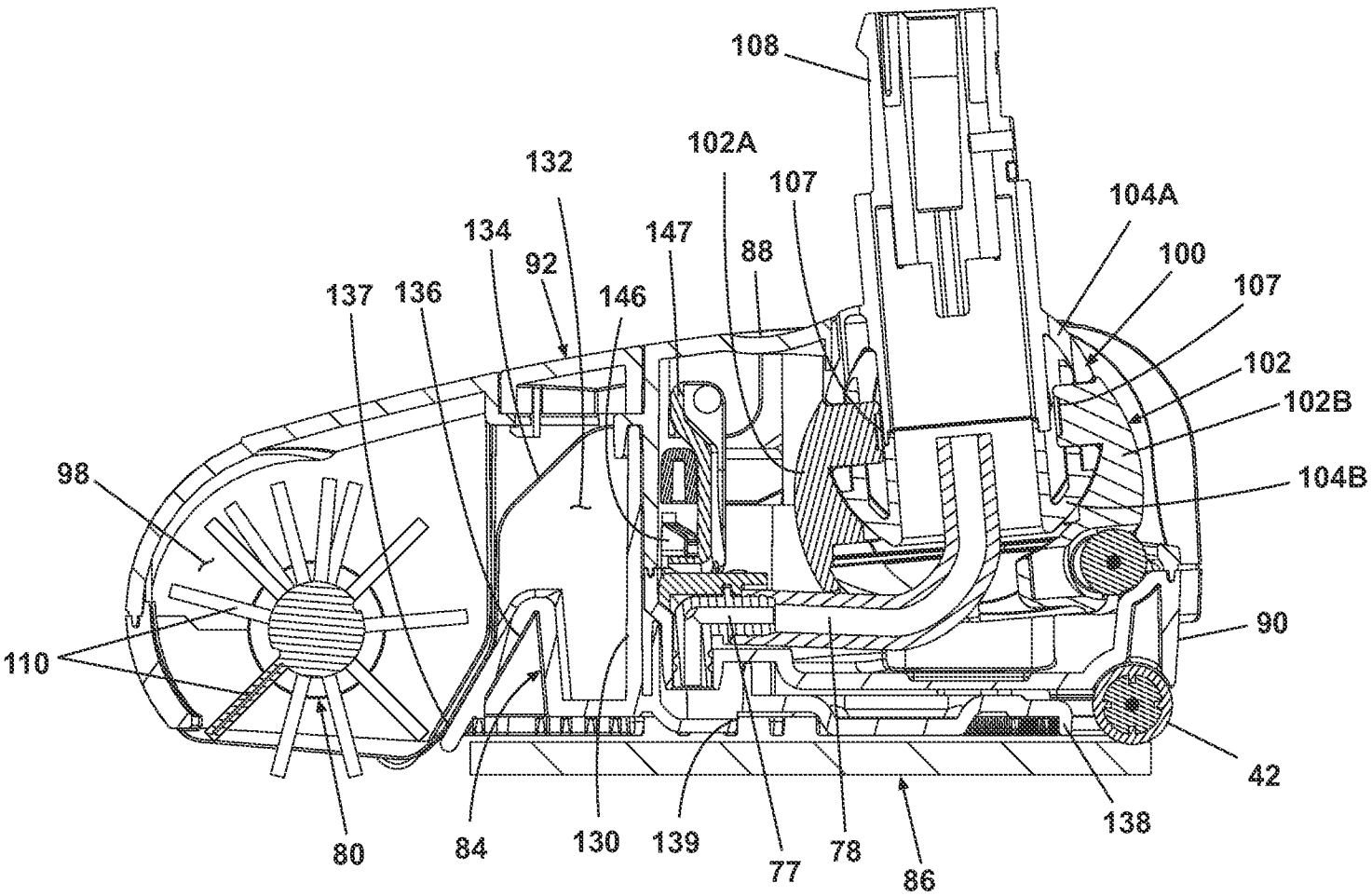
FIG. 7 is a cross-sectional view of the base assembly of FIG. 6.
Figure 8:
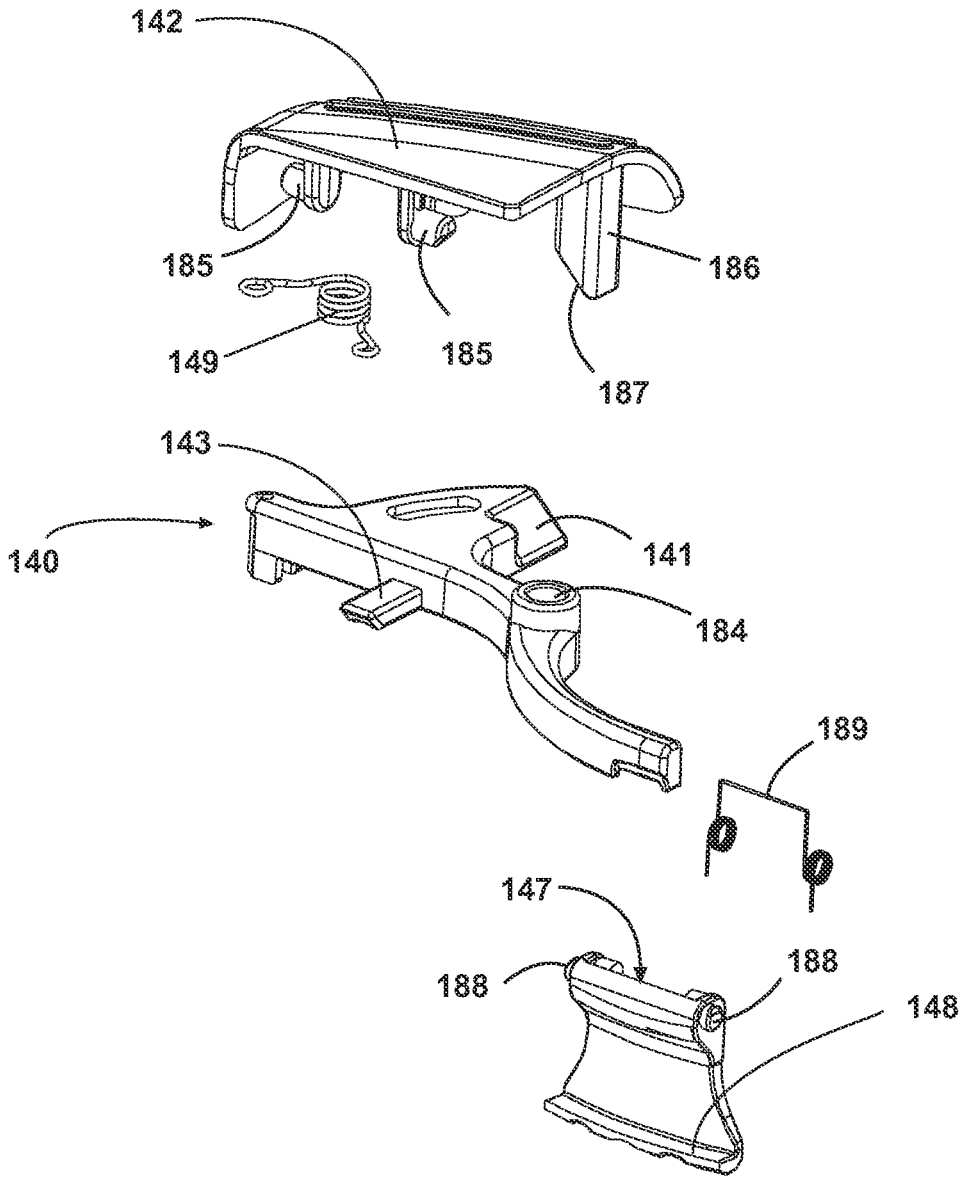
FIG. 8 is an exploded view of a releasable latch mechanism for releasably retaining a dirt receptacle to the base assembly, as shown in FIG. 6A.

Referring additionally to FIG. 7, the rotatably mounted brush assembly 80 comprises a removable brush 110 that is centrally positioned in a brush chamber 98 and held to the base plate 90 by an end bearing 112 and a belt bearing 114 which are inserted into bearing seats 116, 118 provided on the base plate 90 so that the brush 110 can rotate about a horizontal axis to sweep particles through the brush chamber 98 and into the dirt receptacle 84. The brush 110 is driven by the motor 82 through a drive shaft 120, a drive belt 122, and a belt pulley 124. The motor 82 rotates the drive shaft 120 that drives the drive belt 122, which in turn rotates the belt pulley 124 and the brush 110. The upper housing 88 encloses the brush assembly 80 within the brush chamber 98. Optionally, the upper housing 88, or a portion thereof can be made of translucent material, to enable a user to view the rotating brush 110 within the brush chamber 96. The brush 110 can comprise commonly known tufted bristles. Alternatively, the brush can comprise any other cleaning medium made of a soft and compressible material such as fabrics including micro-fiber fabrics, nylon fiber, foams, elastomeric blades and paddles, or any other material suitable for soil transfer and cleaning surface agitation. Further, the brush assembly 80 is designed to be removable, enabling the user to remove and clean the brush 110.

Referring still to FIG. 6, the dirt receptacle 84 comprises a dirt cup 130 defining a dirt chamber 132. The dirt cup 130 has a generally open upper portion that defines the inlet 134 for fluid communication of the dirt chamber 132 with the brush chamber 98 (FIG. 7). Dirt or debris that is swept up by the brush 110 will be propelled into the dirt cup 130. A partition 136 having a ramped front surface 137 is provided at the bottom of the inlet 134 of the dirt cup 130 to guide dirt and debris into the dirt chamber 132 and retain it therein, thereby trapping any dirt or debris removed from the surface to be cleaned by the steam mop sweeper 10. The dirt cup 130 is preferably molded of a transparent material thereby allowing the user to view the debris collected therein.

The dirt receptacle cover 92 is affixed to the upper housing 88 to close off a socket 162 formed in the upper housing 88, in which the dirt receptacle 84 is selectively mounted. Further, the dirt receptacle cover 92 encloses the upper portion of the dirt cup 130 when the dirt receptacle 84 is installed in the base assembly 14. The dirt receptacle cover 92 is preferably made of a translucent plastic material to enable the user to view the dirt and debris retained within the dirt chamber 132.

In one embodiment of the invention, shown in FIGS. 6 and 7, the dirt receptacle 84 is slidingly received into the base assembly 14 through the opening 96 on the underside of the base assembly 14 and into the socket 162 of the upper housing 88. The dirt receptacle 84 comprises a dirt cup flange 138 that includes a through-hole aperture 139. The dirt receptacle 84 is held in the base assembly 14 by any suitable retention means (described in greater detail hereinafter), for example by a suitable releasable locking mechanism such as a release latch 142 which is retained in the upper housing 88 and releasably engages the dirt receptacle 84. The mop cloth 86 is removably mounted to the flange 138 of the dirt receptacle 84 and is configured to contact the cleaning surface when the dirt receptacle 84 is mounted in the socket 162 in the base assembly 14. The mop cloth 86 can be attached by any suitable means, such as commonly known hook and loop style attachment means. In this case, the hook portion can be formed on the underside of the dirt cup flange 138 and embeds in the fiber of the mop cloth 86. Optionally, the mop cloth 86 can comprise a rectangular pad having pockets 87 (FIG. 11) formed along its opposed leading and trailing edges. The pockets 87 can be configured to wrap around the rear edge of the dirt cup flange 138 and the ramped front surface 137 of the dirt receptacle 84 to secure the cloth 86 thereto. In this configuration, the leading edge of the mop cloth 86 that is wrapped around the ramped front surface 137 of the dirt receptacle 84 is preferably adapted to contact and clean the rotating brush 110 by wiping any residual dirt and debris off of the brush 110 during operation.

The mop cloth 86 comprises a dry, microfiber fabric, or any other suitable cleaning material that is preferably washable for reuse, and can additionally include a backing material to provide structure. Alternatively, the mop cloth 86 can comprise a generally flat disposable pad or cleaning sheet structure.

The dirt receptacle 84 is inserted into the base assembly 14 upwardly through the opening 96 in the base plate 90 and into the socket 162 within the upper housing 88, as described above. Accordingly, the mop cloth 86 can be affixed to the flange 138 of the dirt receptacle 84 either before or after the dirt receptacle 84 is installed into the base assembly 14. Thus, the flange 138 functions as a mop cloth plate for mounting the mop cloth 86, and removably mounts the mop cloth 86 to the base plate 90.

Figure 9A:
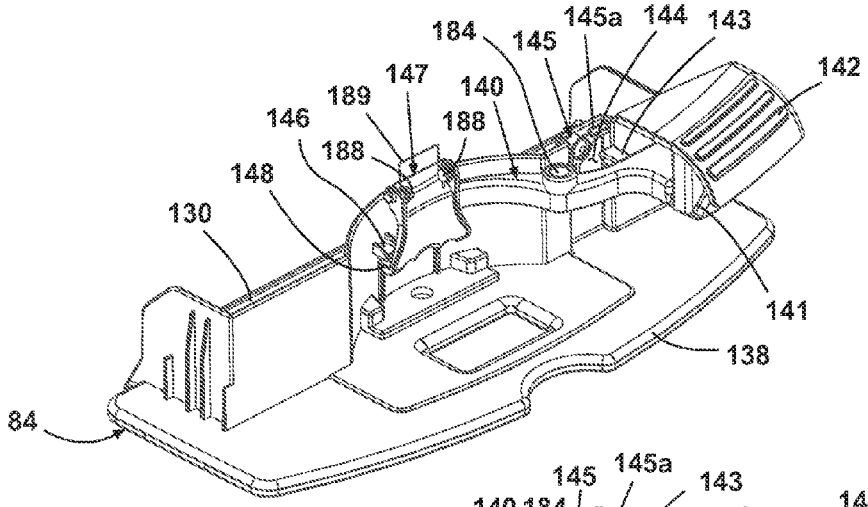
FIG. 9A is a perspective view of the releasable latch mechanism, as shown in FIG. 6A and illustrating a first position in which the dirt receptacle is retained to the base assembly.
Figure 9B:
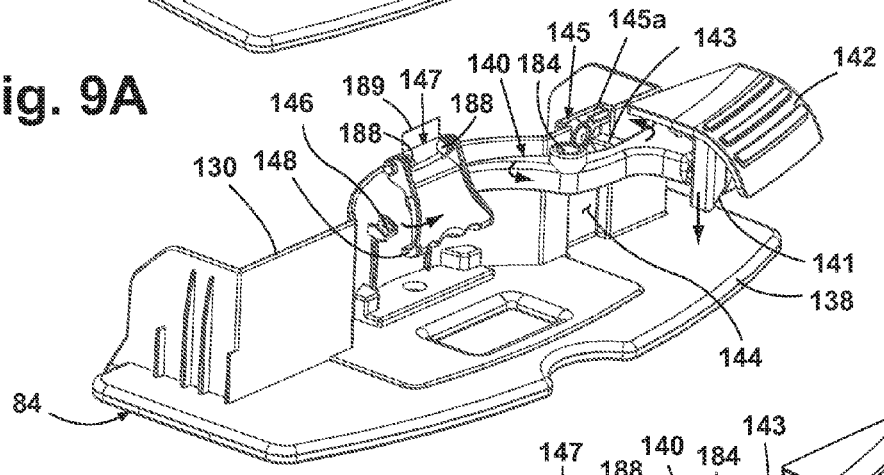
FIG. 9B is a perspective view of the releasable latch mechanism, as shown in FIG. 6A and illustrating an intermediate position in which the dirt receptacle is released from the base assembly.
Figure 9C:
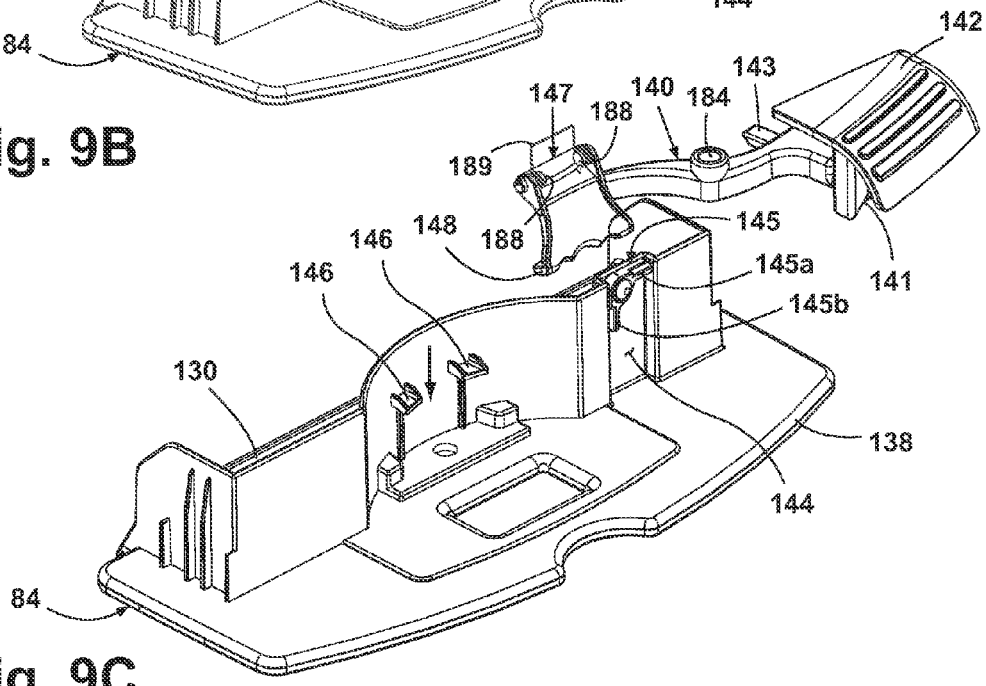
FIG. 9C is a perspective view of the releasable latch mechanism as shown in FIG. 6A and illustrating a second position in which the dirt receptacle is released from the base assembly.
Figure 10A:
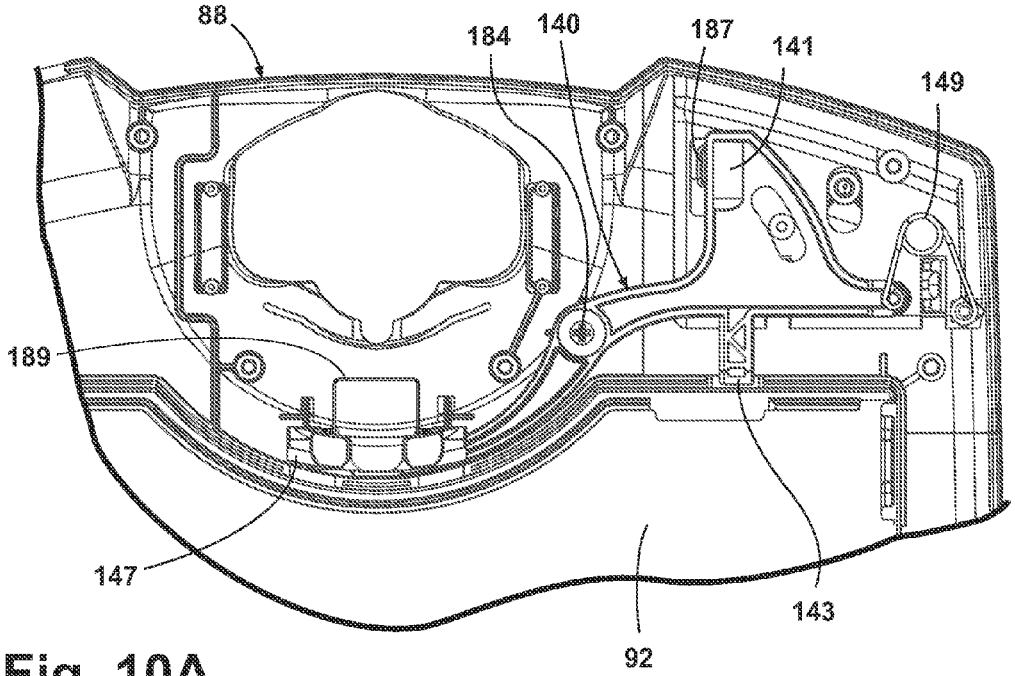
FIG. 10A is an underside view of the upper housing and the releasable latch mechanism of the base assembly shown in FIG. 6, and illustrating the first position shown also in FIG. 9A.
Figure 10B:
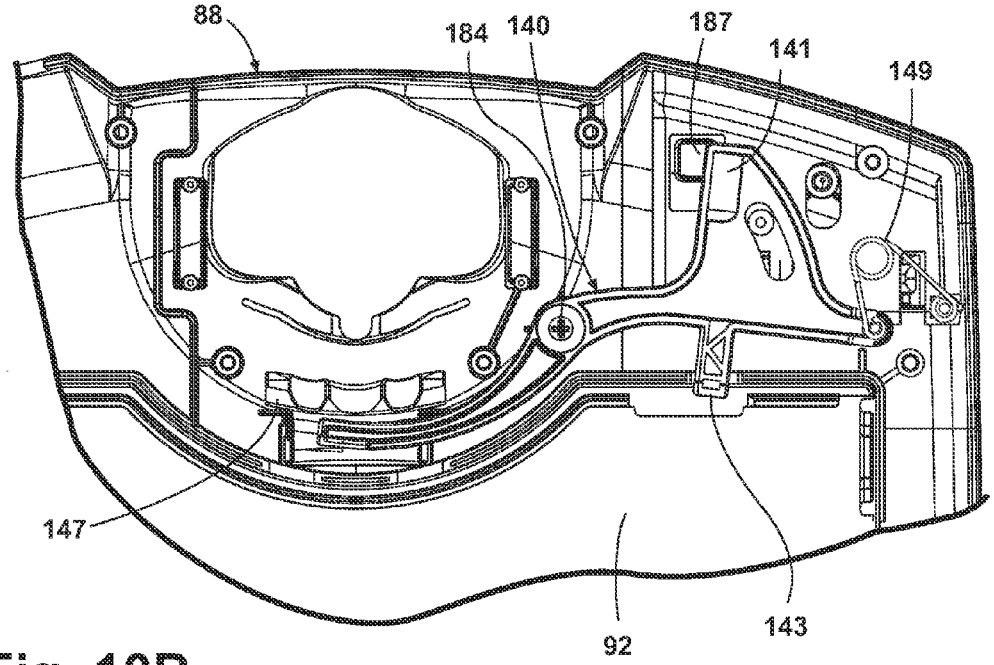
FIG. 10B is an underside view of the upper housing and the releasable latch mechanism of the base assembly shown in FIG. 6, and illustrating the second position shown also in FIG. 9C.

Referring to FIGS. 6A, 8, 9A-C, and 10A-B, the dirt receptacle 84 is retained to the base assembly 14 by a releasable locking mechanism that comprises the release latch 142, a swing arm 140 having a ramped surface 141 and a reset bar 143, a pivot member 147 having a catch 148, a biasing spring 189, and an over-center spring 149 that is mounted to the upper housing 88 and is adapted to selectively bias the swing arm 140. The dirt receptacle 84 further comprises a pivotal lever 145 that is rotatably mounted within a recess 144 and a centrally located retention tab 146. The lever 145 is a generally L-shaped member comprising a horizontal arm 145*a* and a vertical arm 145*b* pivotal about an axis at the vertex. The lever 145 is positioned within the recess 144 so it can rotate counterclockwise, whereas clockwise rotation is blocked by the vertical wall of the recess 144. The first position in which the dirt receptacle 84 is retained to the base assembly 14 is best seen in FIGS. 9A and 10A; the second position in which the dirt receptacle 84 is released from the base assembly 14 is best seen in FIGS. 9C and 10B. To release the dirt receptacle 84 from the base assembly 14, the user depresses the release latch 142, which contacts the ramped surface 141 of the swing arm 140, which is pivotally mounted to the base plate 90 about a vertical axis 184. The release latch 142 is pivotally mounted to the base plate 90 by a pair of opposed pivot arms 185 and further comprises a vertical bar 186 having a ramped surface 187 that presses down on the swing arm 140, causing the mated ramped surfaces 141, 187 of the swing arm 140 and the release latch 142 to slide relative to one another, forcing the swing arm 140 to rotate counterclockwise about its vertical axis 184. The distal end of the swing arm 140 is positioned adjacent the pivot member 147, which is mounted to the upper housing 88 by a pair of opposed pivot arms 188. The spring 189 is also mounted to the pivot arms 188 and biases the pivot member 147 in a forward, locked position. As the swing arm 140 pivots counterclockwise, it contacts the front surface of the pivot member 147 and forces the member 147 to pivot rearwardly about its horizontal axis, as best seen in FIG. 10B. When the pivot member 147 pivots rearwardly, the catch 148 releases the tab 146 formed on the rear wall of the dirt cup 130, as shown in FIG. 9B. Upon releasing the tab 146 from the catch 148, the dirt bin 84 can be removed from the base assembly 14 by lifting the steam mop sweeper 10 upwardly off of the dirt receptacle 84, as shown in FIG. 9C. The lifting motion slidingly disengages the dirt receptacle 84 from the socket 162 in the upper housing 88 and releases it through the opening 96 beneath the base assembly 14. The disengaged dirt receptacle 84 is then easily accessible by a user for emptying debris from the dirt chamber 132 and for replacing the soiled mop cloth 86. This preferred configuration eliminates the need to tip the entire unit to access the mop cloth 86 mounted beneath the base assembly 14. A rear wheel 42 rotatably mounted at the rear portion of the base plate 90 is adapted to stabilize the steam mop sweeper 10 and prevent it from tipping backward upon removal of the dirt receptacle 84.

Additionally, the releasable locking mechanism includes a detent mechanism that is configured to maintain the swing arm 140 and pivot member 147 in an unlocked, released position after the release latch 142 is depressed and until the dirt receptacle 84 has been reinstalled into the base assembly 14. Depressing the release latch 142 forces the swing arm 140 to pivot rearwardly about its vertical axis 184 whereupon the over-center spring 149 biases the swing arm 140 into its rearward released, unlocked position. The spring-biased swing arm 140 continues to force the pivot member 147 into its rearward position, thus maintaining disengagement of the catch 148 and tab 146 and permitting the dirt receptacle 84 to be freely released from the base assembly 14 after a user initially depresses the release latch 142. With the locking mechanism in its unlocked, released position, the reset bar 143 of the swing arm 140 protrudes into the recess 144 of the dirt receptacle 84 and is positioned below the horizontal arm 145*a* of the lever 145. When the steam mop sweeper 10 is lifted upwardly to remove the dirt receptacle 84, the reset bar 143 remains in its protruded position and contacts the horizontal arm 145*a* of the lever 145 forcing it to pivot upwardly. When the reset bar 143 clears the lever 145, the lever 145 pivots freely back to its original position. Upon reinstalling the dirt receptacle 84, the horizontal arm 145*a* of the lever 145 again contacts the reset bar 143; however, the lever 145 is unable to rotate clockwise because the vertical arm 145*b* is blocked by the adjacent vertical wall of the recess 144. Thus, during installation of the dirt receptacle 84, the lever 145 is prevented from pivoting out of the way, and exerts sufficient force on the reset bar 143 to overcome the biasing force of the over-center spring 149. This action releases the detent and pivots the swing arm 140 and the pivot member 147 back to their original positions as shown in FIGS. 9A and 10A, thus causing the catch 148 to once again retain the tab 146, and thereby retaining the dirt receptacle 84 to the base assembly 14.

While not shown in the drawings, it is also contemplated that the steam mop sweeper 10 could alternatively utilize a dirt receptacle with a trap door dustpan dumping mechanism, as is well known in the art.

Figure 11:
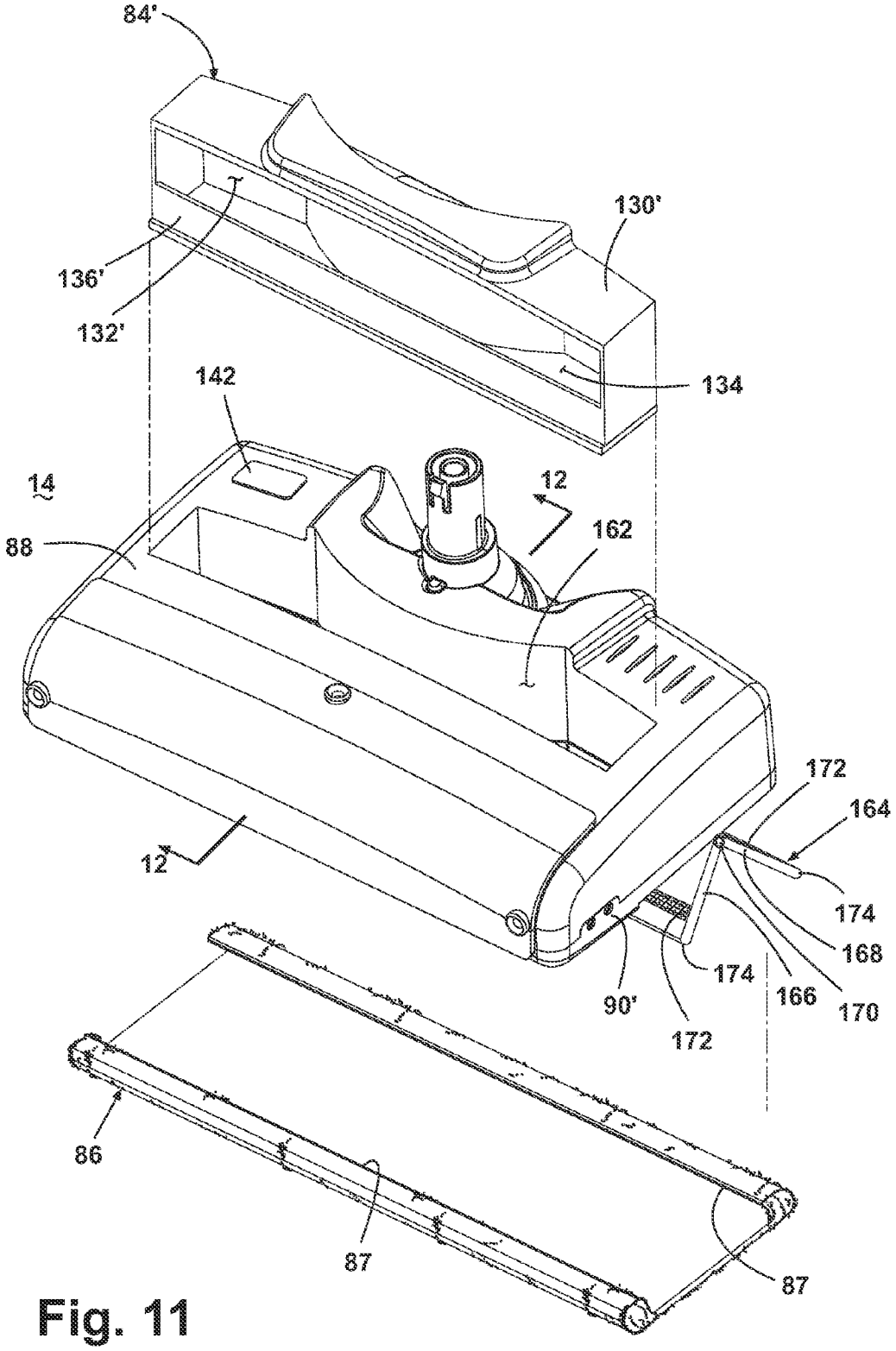
FIG. 11 is an exploded view of the base assembly of the steam mop sweeper, according to a second embodiment of the invention.
Figure 12:
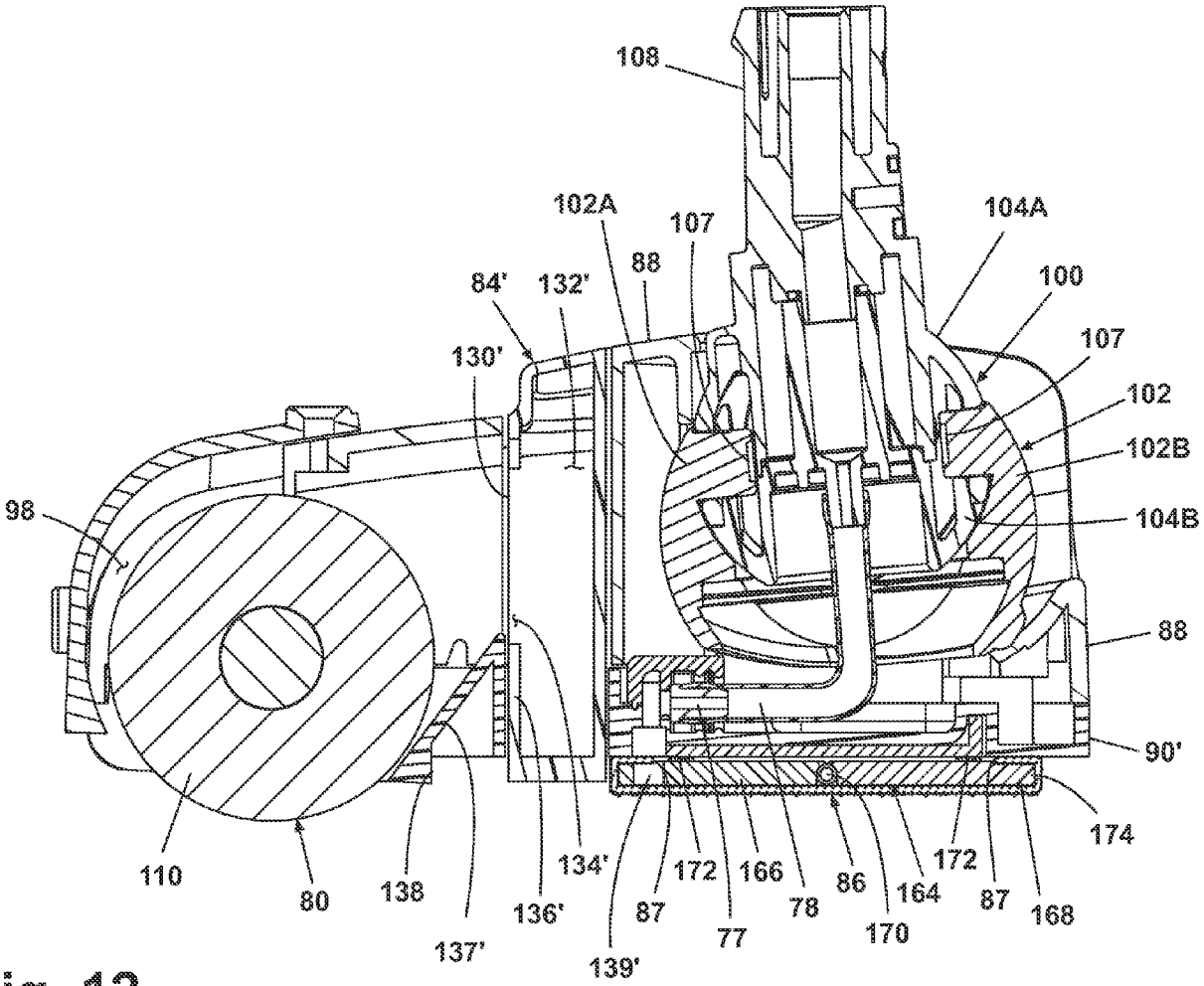
FIG. 12 is a cross-sectional view of the base assembly of FIG. 11.

As shown in FIGS. 11 and 12 in an alternate embodiment where similar elements from the first embodiment are labeled with the same reference numerals, a dirt receptacle 84' comprises a dirt cup 130' defining a dirt chamber 132'. The dirt receptacle 84' of the second embodiment comprises the inlet 134 and a partition 136', but does not include the flange 138, ramped surface 137, or aperture 139. The dirt receptacle 84' is received from the upper surface, or the topside of the base assembly 14, into the socket 162 in the upper housing 88. A ramped surface 137' is included on the base plate 90' to guide dirt and debris into the dirt chamber 132'.

A hinged plate 164 is located on the bottom surface of the base plate 90 and is comprised of a through-hole aperture 139' and two halves 166, 168. The two halves 166, 168 are joined together by a hinge 170, or other suitable articulating means. The hinged plate 164 is attached to the base plate 90 along the hinge 170, facilitating the two halves 166, 168 to pivot from a generally horizontal position to a generally vertical position forming an acute angle between the opposed plate faces. Each half 166, 168 can be retained in the horizontal position by a hook and loop fastener strip 172, or other suitable fastening means. In the illustrated example, a hook or loop strip 172 can be adhered to the interior face of the plate halves 166 and 168, and the mating hook or loop strip 172 can be adhered to each of the base plate 90 and upper housing 88. To pivot the plate halves 166, 168 to their acute angle positions, the user can simply pull on the free side 174 of the plate halves 166, 168 to release the hook and loop strips 172. This is meant to be a non-limiting example of a retention means and other commonly known means are suitable.

The mop cloth 86 is removably attached to the hinged plate 164. The two plate halves 166, 168 of the hinged plate 164 are released from their horizontal position and the pockets 87 of the mop cloth 86 are installed over the free side 174 of each of the plate halves 166, 168. With the mop cloth 86 in position, the plate halves 166, 168 are then pivoted back to their horizontal position, tensioning the mop cloth 86 on the hinged plate 164, thereby retaining the mop cloth 86 to the base assembly 14. As described above, the plate halves 166, 168 are retained in their horizontal position, along with the installed mop cloth 86, by the hook and loop strips 172.

Figure 13:
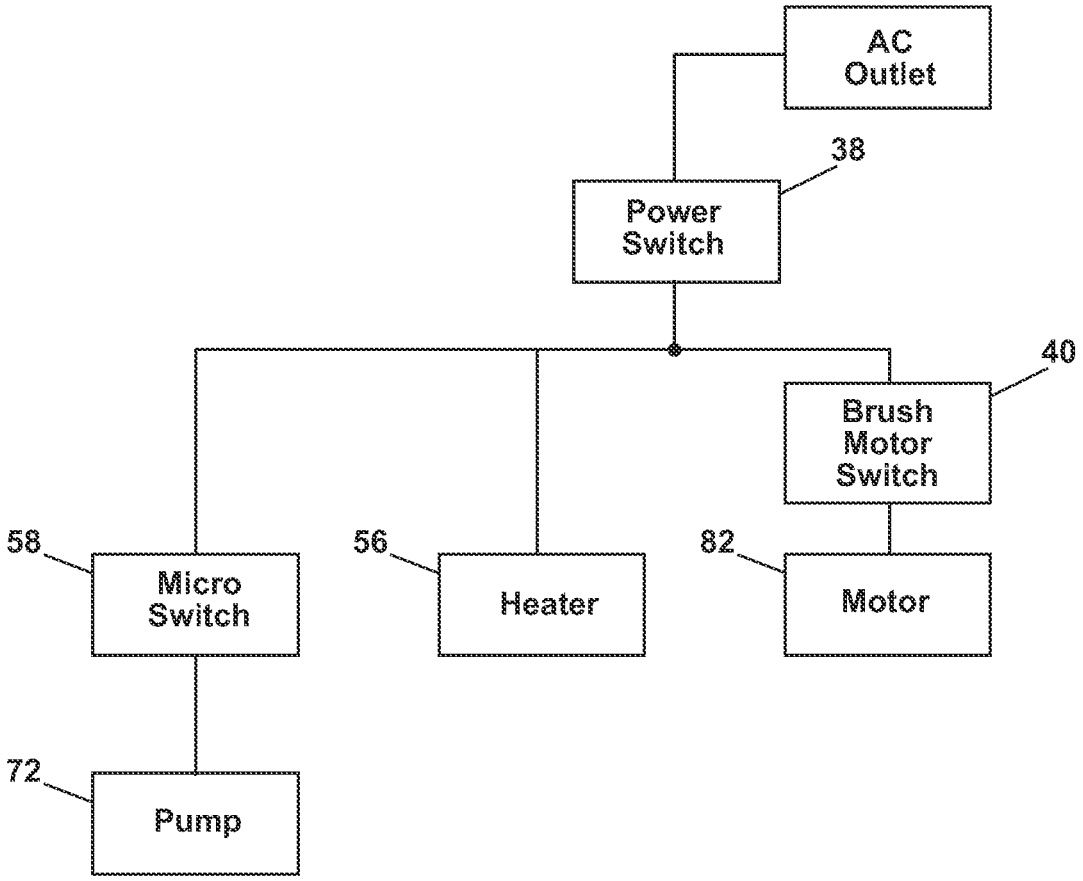
FIG. 13 is a schematic diagram of the electrical system of the steam mop sweeper shown in FIG. 1.

The steam mop sweeper 10 can be operated as a bare floor cleaner that utilizes a disposable or re-usable, washable mop cloth 86 and steam for improved cleaning A schematic diagram of the electrical system of the steam mop sweeper 10 is shown in FIG. 13. In operation, the unit is energized by actuating the power switch 38 and the brush motor 82 is selectively energized by actuating the brush power switch 40. The motor 82 rotates the drive shaft 120 which is operably coupled to the brush 110 via the drive belt 122 such that as the drive shaft 120 rotates, the brush 110 also rotates. As the brush 110 rotates, larger debris is picked up by the brush and thrown upward and rearward within the dirt chamber 132 formed within the dirt receptacle 84. Thrown debris is guided by the ramped front surface 137 and travels over the top of partition 136 and comes to rest in the dirt chamber 132 of the dirt receptacle 84. As the steam mop 10 is moved across the floor, the mop cloth 86 moves over the surface vacated by the brush 110 and picks up the smaller dust and debris left behind and the application of steam improves cleaning When the steam mop sweeper fluid distribution system is activated by depressing the trigger 30, steam is distributed onto mop cloth 86 and transferred to the surface to be cleaned. The user depresses the trigger 30, which activates the pump 72 to draw water from the water tank assembly 64, through the filter assembly 70, first water tube 73, pump 72, and T-connector 74, and then into the heating element 56 where it is heated to generate steam. The steam is conveyed through the steam tube 78 and through the spray nozzle 77 onto the mop cloth 86 where it dampens the mop cloth 86, thereby providing improved cleaning ability of the steam mop sweeper 10.

Figure 14:
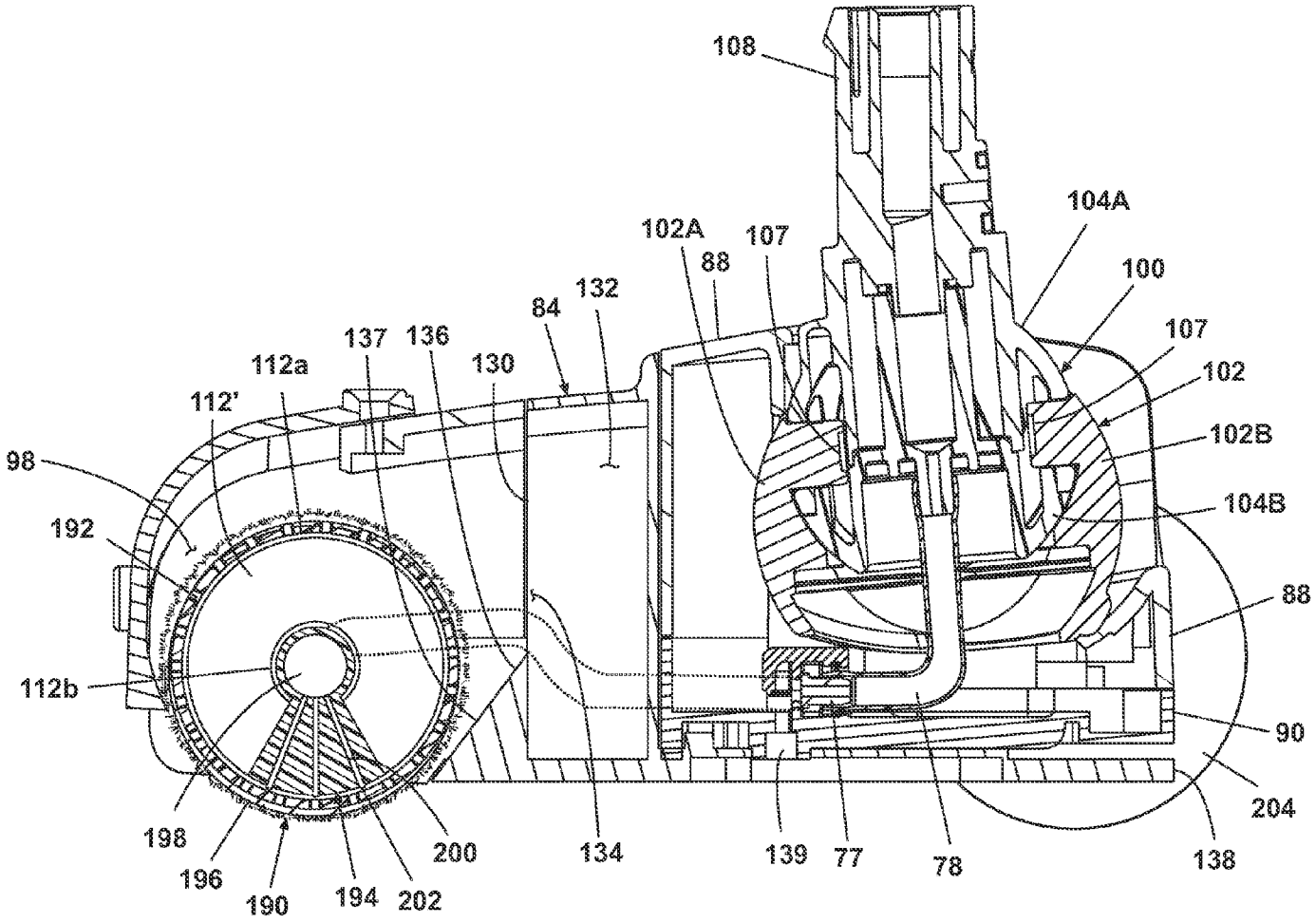
FIG. 14 is a cross-sectional view of the base assembly of the steam mop sweeper, according to a third embodiment of the invention.

As shown in FIG. 14, in a third embodiment where similar elements from the first embodiment are labeled with the same reference numerals, a brush assembly 190 is removably and rotatably mounted to the base plate 90 and comprises a roller frame 192, a stream distribution manifold 194, and a sleeve 196. The roller frame 192 comprises a perforated cylindrical support and is mounted to the rotatable portions 112*a* of an end bearing 112' and a drive bearing (like belt pulley 124, FIG. 6). To position the brush assembly 190 within the brush chamber 98, the stationary portion 112*b* of the end bearing 112' is non-rotatably mounted in the bearing seat 116 provided on the base plate 90. On the opposite end, the stationary portion of the drive bearing is mounted to an end cap 114' (see belt bearing 114, FIG. 6), which is non-rotatably mounted in the seat 118 provided on the base plate 90. The drive bearing has a stationary center attached to the fixed center portion of the end cap 114' and a rotatable outer portion that is rotated by the drive belt 122 and to which the roller frame 192 is mounted. The brush assembly 190 is driven by the motor 82 through the drive shaft 120, the drive belt 122, and the belt pulley 124. The motor 82 rotates the drive shaft 120 that drives the drive belt 122, which will in turn rotate the drive bearing and the brush assembly 190. Alternatively, the roller frame 192 can be formed by a cylindrical cage structure made of wire or plastic, similar to that of the commonly known paint roller cage.

The sleeve 196 is configured to selectively slide over the roller frame 192 and comprises a soft, compressible material, such as a micro-fiber fabric. Further, it is contemplated that the sleeve 196 can be removable for washing the sleeve 196 after repeated uses. The sleeve 196 material can also include bristles or the like, or alternatively, the sleeve 196 can be permanently bonded to the roller frame 192.

The steam distribution manifold 194 is positioned within the roller frame 192 along its longitudinal axis and comprises an elongated steam delivery manifold having a primary steam supply channel 198. The steam supply channel 198 has a steam inlet (not shown) that is fluidly connected to the steam tube 78' for receiving steam. The steam inlet feeds the primary steam supply channel 198, which extends along the longitudinal axis of the manifold 194. The steam supply channel 198 is fluidly connected to a plurality of smaller steam flow channels 200 that project radially outward from a lower portion of the steam supply channel 198. Each steam flow channel 200 fluidly connects the steam supply channel 198 with a steam outlet orifice 202 for delivering steam to the roller cavity within the roller frame 192. Steam is emitted from the roller cavity through perforations in the roller frame 192, thereby saturating the permeable soft fabric sleeve 196. The steam distribution manifold 194 is configured to be fixedly mounted to the stationary center portions 112*b* of the end bearing 112' and end cap 114'.

Because the third embodiment does not incorporate the mop cloth 86, the steam mop sweeper 10 of the third embodiment has two rear wheels 204, as are commonly known in the art.

Figure 15:
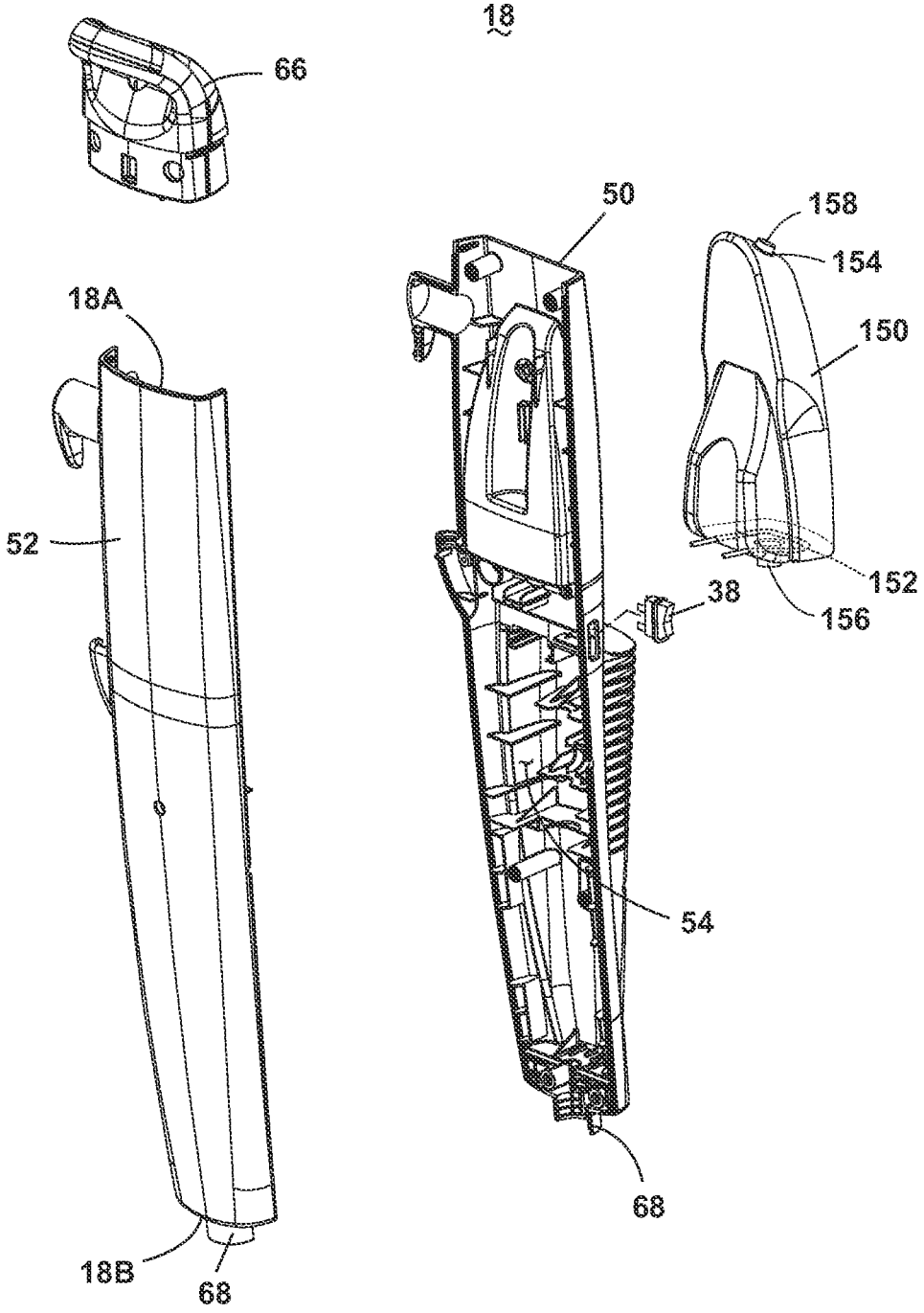
FIG. 15 is an exploded view of a lower handle assembly of the steam mop sweeper, according to a fourth embodiment of the invention.

A fourth embodiment, shown in FIG. 15, where similar elements from the first embodiment are labeled with the same reference numerals, includes an alternate fluid distribution system. The fluid distribution system of the fourth embodiment comprises a heating element 152 located within a steam boiler 150, and does not include the trigger 30, pump 72, micro-switch 58, or pressure relief valve 60 of the first embodiment. The steam boiler 150 comprises a pressure vessel having an inlet 154 configured to receive a removable fill cap 158 at an upper portion and an outlet 156 at a lower portion thereof. The heating element 152 is fixedly mounted within the steam boiler 150 near the bottom and is configured to be electrically coupled to the power source through the power switch 38. The steam boiler 150 outlet 156 is fluidly connected to the steam tube 78 (not shown). As shown in FIG. 7, the spray nozzle 77 is connected at the distal end of the steam tube 78 for dispensing steam to the mop cloth 86.

In operation, the user removes the fill cap 158, pours water into the steam boiler 150, and seals the inlet 154 with the fill cap 158. The user then activates the power switch 38, which energizes the heating element 152 located within the steam boiler 150, thereby heating the water in the steam boiler 150 to its boiling point to generate steam. The steam is conveyed through the tank outlet 156, into the steam tube 78 and through the spray nozzle 77 onto the mop cloth 86 where it dampens the mop cloth 86, thereby providing improved cleaning ability of the steam mop sweeper 10.

Figure 16:
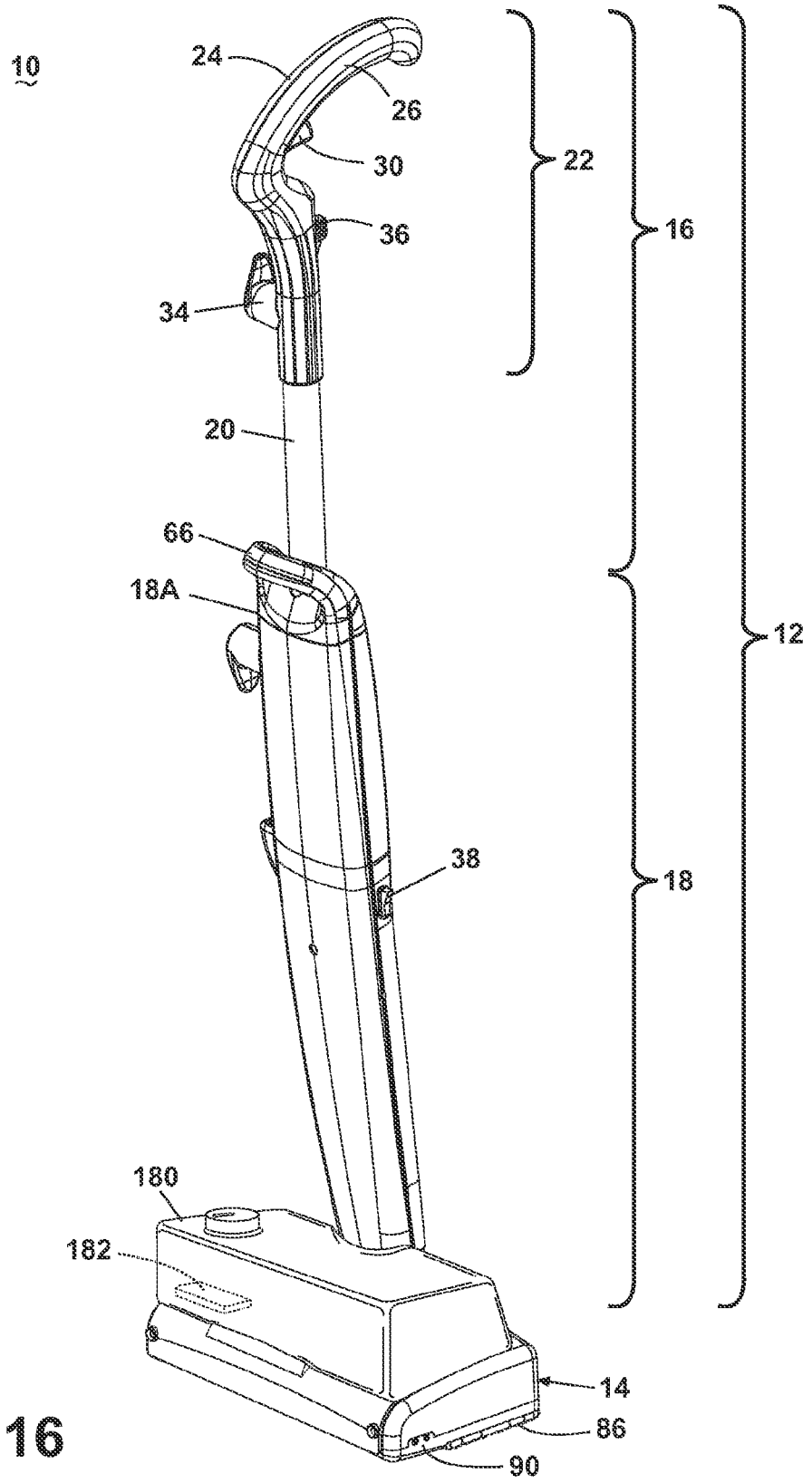
FIG. 16 shows a steam mop sweeper according to a fifth embodiment of the invention.

The invention has been described with respect to a base assembly 14 for movement along the surface to be cleaned and a pivotally mounted handle assembly 12 that includes a water tank 64 or steam boiler 150. However, it is within the scope of the invention to mount all or some of the functional components of the steam mop sweeper 10 on the base assembly 14, instead of on the handle assembly 12. As shown in FIG. 16, similar in functionality to the first embodiment, has the water tank 180 and associated heating element 182 (or steam boiler as in the fourth embodiment) mounted on the base assembly 14.

Sweeping is an effective substitute for vacuuming that typically requires less electrical power. Thus, sweeping and steaming functions can be combined in a single device that requires power levels below that of typical power supply limits for domestic households in the North American Continent and other 120V markets. One of the benefits of this combination of elements is the ability for simultaneous sweeping and steaming functions having power consumption requirements within acceptable levels commensurate with typical 120V household markets. This combination of elements eliminates the need for a two-step cleaning process and other issues associated with alternate cleaning methods. Further, utilizing a motor driven sweeper avoids the noise associated with vacuum cleaner motors and blower fans, thus resulting in a relatively quiet operation of the floor cleaner. The steam mop sweeper is the only product that combines all the above mentioned benefits into one small and quiet device.

While the invention has been described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A bare floor cleaner comprising:

a base housing which is movable along a surface to be cleaned;

an upright housing pivotally mounted to the base housing;

a universal joint between the base housing and the upright housing;

a steam generator mounted in one of the base housing and the upright housing;

a mop cloth plate removably mounted to the base housing;

a mop cloth removably mounted to the mop cloth plate and positioned for contacting the surface to be cleaned; and a fluid distributor mounted in the base housing and connected to the steam generator to distribute steam to the mop cloth;

a retention mechanism releasably retaining the mop cloth plate on the base housing, wherein the mop cloth is configured to be removably retained on the mop cloth plate so that the mop cloth plate and the mop cloth can be simultaneously removed from or mounted to the base housing as a unit, wherein the retention mechanism is a locking mechanism comprising:

a catch configured to engage the mop cloth plate for retaining the mop cloth plate on the base housing;

a release latch operably coupled with the catch for selectively releasing the catch from the mop cloth plate when the release latch is actuated, and a detent mechanism for releasably retaining the catch in a released position when the mop cloth plate is removed from the base housing, and the detent mechanism further is adapted to reset the catch to releasably retain the mop cloth plate on the base housing when the mop cloth plate is replaced on the base housing.

2. The bare floor cleaner according to claim 1, wherein the release latch is configured to be operated by the foot of a user.

3. The bare floor cleaner according to claim 2 wherein the release latch is provided on the base housing.

4. The bare floor cleaning according to claim 1 wherein the detent mechanism further comprises an over-center spring that biases the catch to the released position.

5. The bare floor cleaning according to claim 4, wherein the locking mechanism further comprises an arm operably coupling the release latch with the catch, wherein the arm is biased by the over-center spring to move the catch to the released position.

6. The bare floor cleaner according to claim 1, wherein the base housing has an opening therein and the mop cloth plate is installed on the base housing through the opening, and wherein the detent mechanism comprises a lever which is positioned in the opening after the mop cloth plate is removed from the base housing and is moved from the opening when the mop cloth plate is replaced in the opening to reset the catch.

7. The bare floor cleaner according to claim 1 and further comprising a dirt receptacle positioned in the base housing, wherein the mop cloth plate comprises a portion of the dirt receptacle.

8. The bare floor cleaner according to claim 7, wherein the portion of the dirt receptacle comprises a flange on the dirt receptacle and the mop cloth is removably attached to the flange.

9. The bare floor cleaner according to claim 1, wherein the upright housing comprises a handle for maneuvering the base housing along the surface to be cleaned.

10. The bare floor cleaner according to claim 9 and further comprising a trigger on the handle operably connected to the fluid distributor for selectively distributing steam onto the surface to be cleaned.

11. The bare floor cleaner according to claim 1 and further comprising:

a sweeper mounted to the base housing and adapted to contact the surface to be cleaned to remove dust and dirt particles therefrom; and a dirt receptacle positioned in the housing in a location to receive the dust and dirt particles swept from the surface to be cleaned by the sweeper.

12. The bare floor cleaner according to claim 11 and further comprising a motor mounted on the base housing and operably connected to the sweeper for rotationally driving the sweeper.

13. The bare floor cleaner according to claim 11, wherein the dirt receptacle is slidably received within the base housing and is installed into the base housing through an opening a lower surface of the base housing.

14. The bare floor cleaner according to claim 11, wherein the sweeper comprises one of:

a brush made of tufted bristles;

a brush made of blades or paddles; and a brush made of a soft and compressible material.

15. The bare floor cleaner according to claim 1 and further comprising:

a tank mounted to one of the base housing and the upright housing, and adapted to hold a quantity of fluid; and a fluid distribution system between the tank and the steam generator for distributing fluid from the tank to the steam generator.

16. The bare floor cleaner according to claim 1, wherein the fluid distributor is positioned above the mop cloth for distributing steam to the mop cloth.

17. A bare floor cleaner comprising:

a base housing which is movable along a surface to be cleaned;

an upright housing pivotally mounted to the base housing by a universal joint;

a fluid distribution system comprising:

a fluid distributor mounted in the base housing for distributing fluid to the surface to be cleaned;

a water tank mounted to the upright housing and adapted to hold a quantity of water;

a conduit between the water tank and the fluid distributor and extending through the universal joint to convey fluid from the water tank to the fluid distributor; and a heating element in the conduit for heating the water from the water tank to steam, whereby the steam is distributed to the surface to be cleaned by the fluid distributor;

a mop cloth plate mounted to the base housing;

a mop cloth removably mounted to the mop cloth plate and positioned for contacting the surface to be cleaned; and a foot operated release mechanism releasably mounting the mop cloth plate to the base housing, the release mechanism comprising:

a pivot member having a catch configured to engage the mop cloth plate for retaining the mop cloth plate on the base housing; and a release latch configured to be operated by the foot of a user operably coupled with the pivot member for selectively releasing the catch from the mop cloth plate when the release latch is actuated;

wherein the mop cloth is configured to be removably retained on the mop cloth plate so that the mop cloth plate and the mop cloth can be simultaneously removed from or mounted to the base housing as a unit.

18. The bare floor cleaner according to claim 17 and further comprising a dirt receptacle positioned in the base housing, wherein the mop cloth plate comprises a portion of the dirt receptacle.

19. The bare floor cleaner according to claim 18, wherein the portion of the dirt receptacle comprises a flange on the dirt receptacle and the mop cloth is removably attached to the flange.

20. The bare floor cleaner according to claim 17 and further comprising a sweeper mounted to the base housing and adapted to contact the surface to be cleaned to remove dust and dirt particles therefrom.

* * * * *